US010870309B2

(12) United States Patent
Tani

(10) Patent No.: US 10,870,309 B2
(45) Date of Patent: Dec. 22, 2020

(54) SHARPENER

(71) Applicant: TOKIWA CORPORATION, Nakatsugawa (JP)

(72) Inventor: Yoshikazu Tani, Kawaguchi (JP)

( * ) Notice: Subject to any disclaimer, the term of this patent is extended or adjusted under 35 U.S.C. 154(b) by 31 days.

(21) Appl. No.: 15/796,859

(22) Filed: Oct. 30, 2017

(65) Prior Publication Data

US 2018/0117953 A1 May 3, 2018

(30) Foreign Application Priority Data

Nov. 2, 2016 (JP) ..... 2016-215499

(51) Int. Cl.
*B43L 23/08* (2006.01)
*B43L 23/06* (2006.01)

(52) U.S. Cl.
CPC ..... *B43L 23/085* (2013.01); *B43L 23/06* (2013.01)

(58) Field of Classification Search
CPC ..... B43L 23/06; B43L 23/004; B43L 23/00; B43L 23/08; B43L 23/085
USPC ..... 30/456, 457, 460
See application file for complete search history.

(56) References Cited

U.S. PATENT DOCUMENTS 174,777 A * 3/1876 Buzby ..... B43L 23/08 30/452
228,923 A * 6/1880 Norton ..... B43L 23/06 30/456
466,734 A * 1/1892 Broomell ..... B43L 23/06 30/453
1,077,778 A * 11/1913 Wolf ..... B43L 23/06 30/136
3,851,687 A 12/1974 Jones
6,279,238 B1 * 8/2001 Gillson ..... B43L 23/06 30/456
6,966,117 B1 * 11/2005 Cannon ..... B43L 23/06 30/451
7,523,557 B2 * 4/2009 Smith ..... B43L 23/08 30/451
2013/0174429 A1 * 7/2013 Constantine ..... B43L 23/008 30/454

FOREIGN PATENT DOCUMENTS

| | | | |
|---|---|---|---|
| CN | 86202858 | 5/1987 | |
| CN | 2075599 | 4/1991 | |
| DE | 520503 C * | 3/1931 | ..... B43L 23/06 |
| FR | 2679492 A1 * | 1/1993 | ..... B43L 23/06 |
| JP | 0019270 | 1/1911 | |
| JP | S17-011857 | 10/1942 | |
| JP | S38-018323 | 9/1963 | |
| JP | H1-158196 | 11/1989 | |

OTHER PUBLICATIONS

English Translation FR2679492. (Year: 1993).*

* cited by examiner

*Primary Examiner* — Jennifer B Swinney
(74) *Attorney, Agent, or Firm* — SOEI Patent & Law Firm

(57) ABSTRACT

The sharpener includes a main body into which the tip portion of the pencil is inserted, and a blade portion installed inside the main body. The tip portion of the pencil is inserted into the main body, and a guide hole for guiding the tip portion of the inserted pencil to the blade portion is formed in the main body. The pencil slides in the guide hole in an axial direction, and the blade portion sharpens the tip portion of the pencil along a plane inclined with respect to the axial direction.

19 Claims, 14 Drawing Sheets

SHARPENER

CROSS-REFERENCE TO RELATED APPLICATIONS

This application claims the benefit of priority from Japanese Patent Application No. 2016-215499, filed Nov. 2, 2016, the entire contents of which are incorporated herein by reference.

BACKGROUND OF THE INVENTION

Field of the Invention

The present invention relates to a sharpener for sharpening a tip portion of a pencil.

Related Background Art

In the related art, various sharpeners are known as a sharpener for sharpening a tip portion of a conventional pencil. For example, Japanese Unexamined Utility Model Publication No. 1-158196 discloses a polisher for polishing a drawing pencil. This polisher includes an outer housing, an inner housing movable with respect to the outer housing, a pencil insertion hole formed so as to penetrate the outer housing, and a cutter located at a position facing the pencil insertion hole of the inner housing.

In this polisher, the tip portion of a pencil is inserted into the pencil insertion hole, and the pencil is rotated, thereby enabling the cutter to sharpen a wooden portion of the pencil into a conical shaped tip portion. The polisher includes a pencil insertion hole disposed separately from the above-described pencil insertion hole, and a polishing unit disposed inside the inner housing. The pencil inserted into the pencil insertion hole is brought into contact with two polishing pieces of the polishing unit. In this manner, a lead tip of the pencil is polished so as to have a predetermined lead thickness.

As illustrated in FIGS. 14A and 14B, another type of pencil 100 includes a lead 102 and a wooden portion 103 of a tip portion 101 which are sharpened in a planar shape instead of a conical shape. The planar shape of the pencil 100 may also be called a long sword shape. In the pencil 100, a plurality of planar portions are formed in the tip portion 101. That is, the tip portion 101 has a flat shape.

In the pencil 100, the lead 102 is linearly formed in the tip portion 101. Accordingly, a detailed drawing can be made using a narrow portion 102*a* of the lead 102. In the pencil 100, the wooden portion 103 has a plurality of portions 103*a* extending lengthwise to the tip. Therefore, a configuration can be adopted in which the lead 102 is less likely to be broken. The pencil 100 may be produced with a knife that is held with a hand. For example, the pencil 100 may be sharpened using the hand-held knife in a planar shape from one side of the pencil 100 in a radial direction, and the opposite side of the pencil 100 may also be sharpened in a planar shape using the hand-held knife in a similar manner.

SUMMARY

As described above, the pencil 100 in which the plurality of planar portions are formed in the tip portion 101 is produced as follows. A person holding the cutter with the hand sharpens the pencil 100 by using the cutter from one side and the opposite side in the radial direction. In this way, the pencil 100 is produced by being sharpened with the hand. Consequently, it takes time to produce the pencil 100, and actually, the pencil 100 cannot be easily produced.

The pencil 100 is manually produced. Thus, the produced pencil 100 has uneven quality depending on whether or not a producer who produces the pencil 100 is skilled. For example, in a case where an unskilled producer produces the pencil 100, a problem arises in that the lead 102 may be broken while being sharpened or the pencil 100 may not be satisfactorily sharpened.

The present invention aims to provide a sharpener which can easily produce a pencil having a planar portion formed at a tip portion and can suppress uneven quality of the pencil.

According to the present invention, there is provided a sharpener for sharpening a tip portion of a pencil. The sharpener includes a main body into which the tip portion of the pencil is inserted, and a blade portion installed inside the main body. The main body has a guide hole into which the tip portion of the pencil is inserted and which guides the tip portion of the inserted pencil to the blade portion. The pencil slides in the guide hole in an axial direction. The blade portion sharpens the tip portion of the pencil sliding in the guide hole, along a plane inclined with respect to the axial direction.

In the sharpener, the pencil inserted into the main body is guided to the blade portion by the guide hole formed in the main body. The tip portion of the pencil guided by the guide hole reaches a blade edge of the blade portion, and the blade edge comes into contact with the tip portion of the pencil so as to sharpen the tip portion of the pencil. The pencil slides in the guide hole in the axial direction, and the blade portion sharpens the tip portion along the plane inclined with respect to the axial direction. Accordingly, a planar portion extending along the plane and inclined with respect to the axial direction is formed in the tip portion of the pencil. Therefore, the tip portion of the pencil is inserted into the guide hole, thereby enabling the pencil having the planar portion formed therein to be promptly produced. Accordingly, this type of pencil can be easily produced. It is possible to reduce efforts in sharpening the pencil by using a cutter held with a producer's hand. Therefore, it is possible to suppress uneven quality of the pencil.

The sharpener may include a contact portion that comes into contact with the inserted pencil so that a portion of the pencil other than the tip portion is separated from a blade edge of the blade portion. In this case, the contact portion comes into contact with the pencil. Accordingly, it is possible to prevent the blade edge of the blade portion from coming into contact with the other portion of the pencil. Therefore, it is possible to prevent the other portion of the pencil from being sharpened.

The main body may include a fixing member to which the blade portion is fixed, and a cover which accommodates the fixing member and has the guide hole formed therein. In this case, the guide hole guides the tip portion of the pencil to the blade portion, and brings the tip portion of the pencil into contact with the fixed blade portion. The blade portion is fixed to the fixing member. Thus, the tip portion can be more reliably brought into contact with the blade portion. That is, a position of the blade portion can be stabilized, and the tip portion of the pencil can be more reliably brought into contact with the blade portion. Therefore, the tip portion of the pencil can be more smoothly sharpened.

The blade portion may have a first surface extending from a blade edge, and a second surface forming an acute angle with the first surface and having an area smaller than an area of the first surface. The blade portion may be installed so that the second surface faces away from the pencil. In this case, an acute angle portion of the blade edge faces the pencil, thereby enabling the blade edge to easily reach the pencil. Therefore, compared to a case where the acute angle portion of the blade edge faces away from the pencil, the tip portion of the pencil can be more smoothly sharpened.

The pencil may have a lead and a covering portion for covering the lead. The blade portion may sharpen both the lead and the covering portion of the inserted pencil. In this case, the tip portion of the pencil is brought into contact with the blade portion, thereby enabling the blade portion to sharpen both the lead and the covering portion. Therefore, the tip portion of the pencil can be efficiently sharpened.

The guide hole may have a first inner peripheral portion shaped to correspond with an outer periphery of the pencil, and a second inner peripheral portion located on the blade portion side of the guide hole. The second inner peripheral portion forms a shape spreading outward from the first inner peripheral portion. In this case, the guide hole includes the first inner peripheral portion shaped along the outer periphery of the pencil opposite to the blade portion. In this manner, movement of the pencil that is inserted into the guide hole can be regulated or limited in the radial direction. Accordingly, in a stable state, the pencil can be inserted into the guide hole. Therefore, the tip portion of the pencil can be smoothly sharpened. The guide hole includes the second inner peripheral portion located on the blade portion side and forming the shape spreading from the first inner peripheral portion. In this manner, even if the position of the pencil inserted into the guide hole is inclined in the axial direction, contact between the pencil and a wall surface of the guide hole may be minimized. That is, in a case where an inner periphery of the guide hole is shaped along the outer periphery of the pencil, the pencil comes into contact with the wall surface of the guide hole when the pencil is inserted into the guide hole. Thus, the pencil may not be efficiently sharpened in some cases. In contrast, as described above, in a case where the guide hole includes the spread second inner peripheral portion, a configuration can be adopted in which the pencil is less likely to come into contact with the wall surface of the guide hole even if the pencil is inclined. Accordingly, the pencil can be more smoothly inserted into the guide hole. Therefore, the pencil can be more efficiently sharpened.

According to the present invention, it is possible to easily produce a pencil having a planar portion formed at a tip portion, and it is possible to suppress uneven quality of the pencil.

DESCRIPTION OF THE EMBODIMENTS

Figure 1:
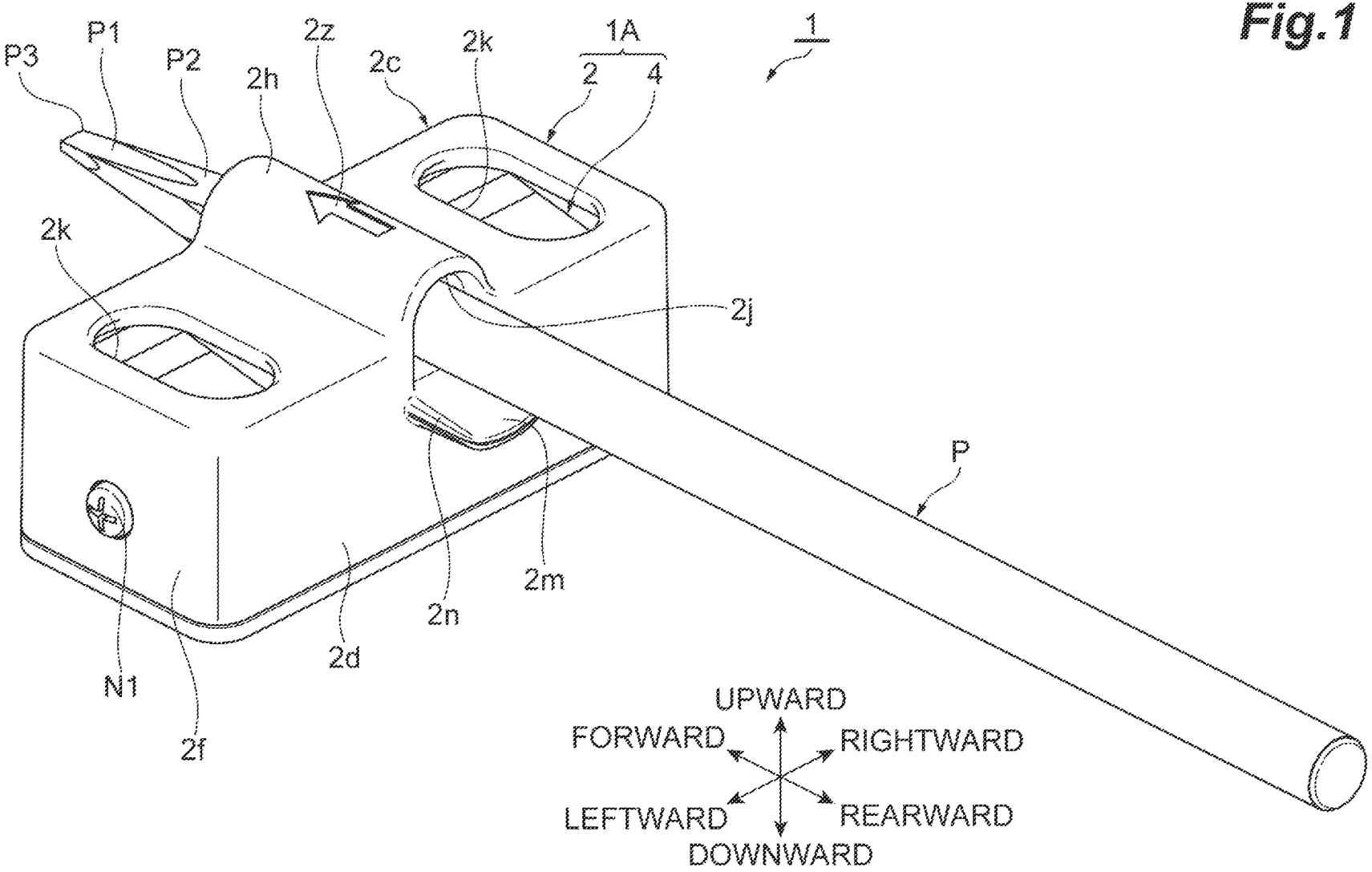
FIG. 1 is a perspective view of a sharpener and a pencil according to an embodiment.

Hereinafter, embodiments of a sharpener according to the present invention will be described with reference to the drawings. In the following description, the same reference numerals will be given to the same or corresponding elements, and repeated description will be omitted.

Figure 2A:
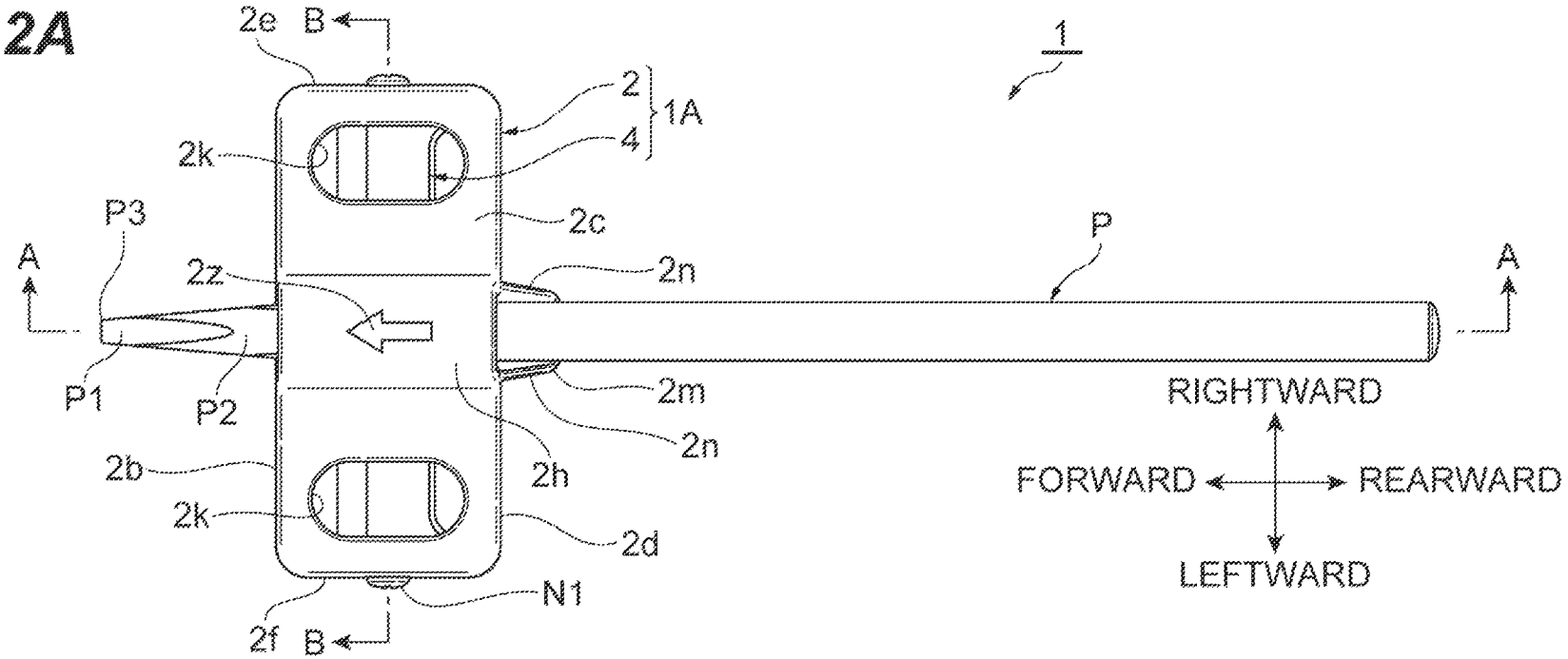
FIG. 2A is a plan view illustrating the sharpener and the pencil in FIG. 1.
Figure 2B:
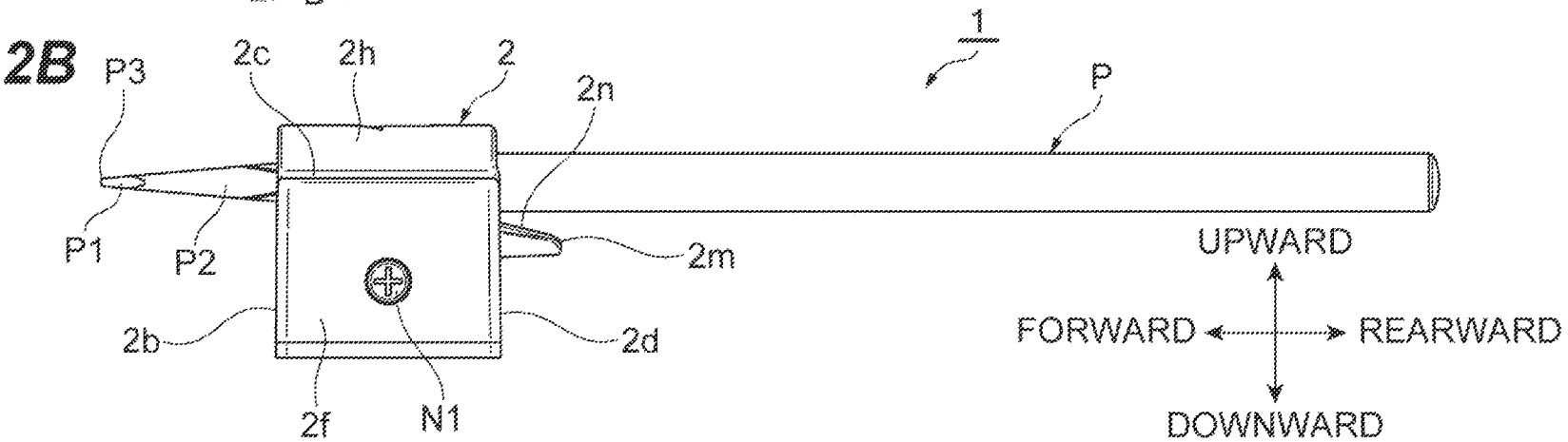
FIG. 2B is a side view illustrating the sharpener and the pencil in FIG. 1.
Figure 3:
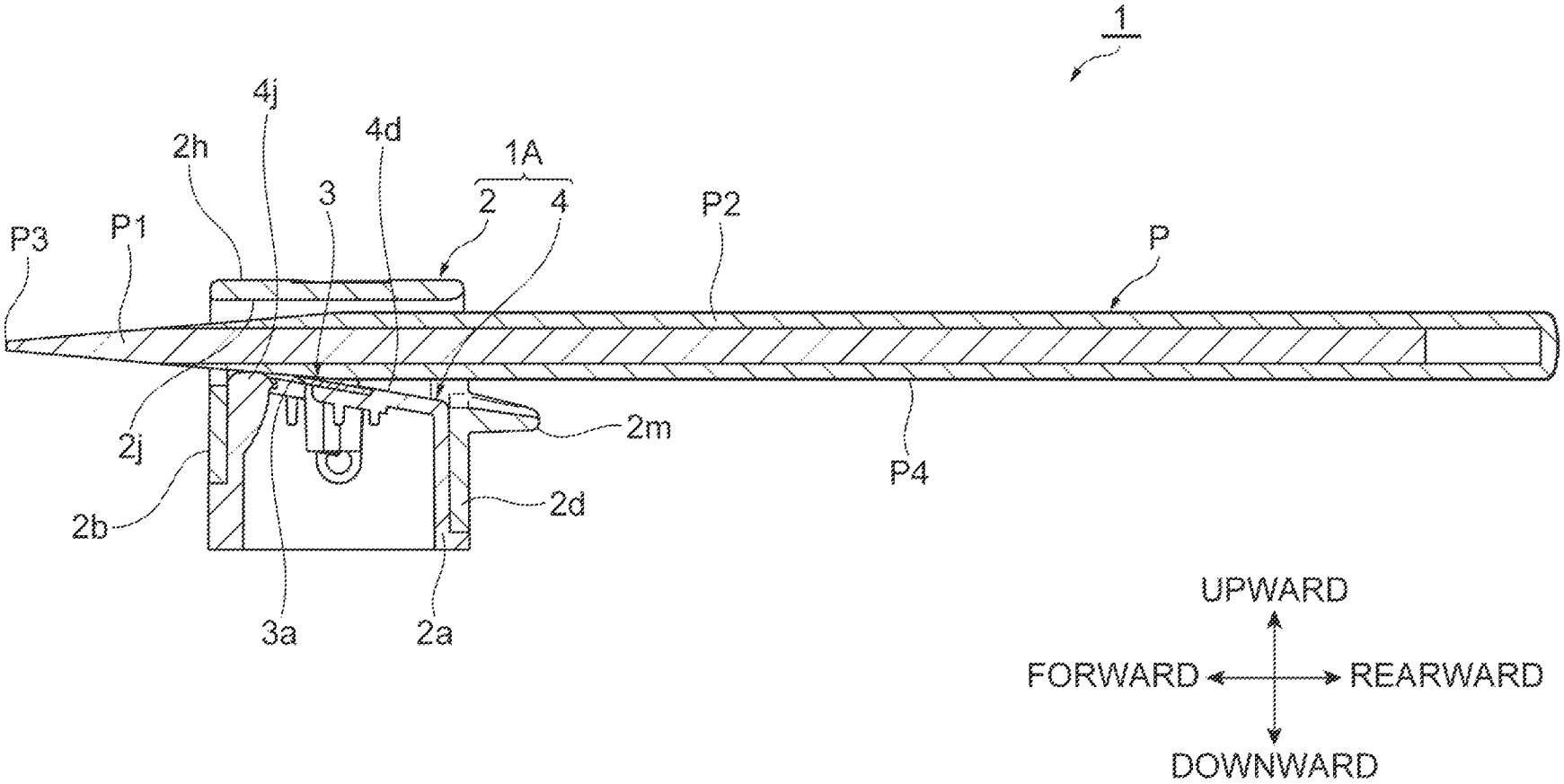
FIG. 3 is a sectional view taken along line A-A in FIG. 2A.

FIG. 1 is a perspective view illustrating a sharpener and a pencil according to one or more embodiments. FIG. 2A is a plan view illustrating the sharpener and the pencil in FIG. 1. FIG. 2B is a side view illustrating the sharpener and the pencil in FIG. 1. FIG. 3 is a sectional view taken along line A-A in FIG. 2A. As illustrated in FIGS. 1 to 3, a sharpener 1 according to one or more embodiments is used when a pencil P is sharpened.

The pencil P forms a bar shape whose entire shape is elongated, and has a round bar shape. In one or more embodiments, the pencil P is sharpened into a long sword shape by the sharpener 1. Here, the long sword shape shows a shape of the pencil P sharpened along a plane inclined with respect to an axial direction of the pencil P (longitudinal direction of the pencil P). That is, a plurality of planar portions inclined with respect to the axial direction are formed in a tip portion P3 of the pencil P, and the tip portion P3 has a flat shape. In one or more embodiments, the planar portion shows a plane inclined radially inward of the pencil P toward a tip of the pencil P.

The pencil P includes a lead P1 used for drawings and a covering portion P2 for covering the lead P1. The covering portion P2 is typically a wooden portion such as an incense cedar. However, the covering portion P2 may be made of a material other than the wooden portion, for example, such as a synthetic resin mixture material. The pencil P may include a pencil, a writing instrument, a drawing material, a cosmetic pencil, or a drawing pencil. The cosmetic pencil may include an eye liner, eye brow liner, a lip liner, or a highlighter. The sharpener 1 includes a main body 1A including a cover 2 into which the pencil P is inserted and a fixing member 4 accommodated in the cover 2, and a blade portion 3 fixed to the fixing member 4 inside the cover 2.

In the following description, as illustrated by arrows in each drawing, a direction in which the pencil P is inserted into the sharpener 1 is referred to as a forward direction, a direction in which the pencil P is drawn from the sharpener 1 is referred to as a rearward direction, a direction in which the blade portion 3 and the fixing member 4 are disposed when viewed from the pencil P inserted into the cover 2 is referred to as a downward direction, and a direction opposite to the downward direction is referred to as an upward direction. A direction perpendicular to both a forward/rearward direction and an upward/downward direction will be described as a rightward/leftward direction. These directions are merely set for convenience of description.

The tip portion P3 of the pencil P is inserted into the main body 1A of the sharpener 1 in the forward/rearward direction. The forward/rearward direction coincides with the axial direction of the pencil P, the longitudinal direction of the pencil P, and the extending direction of the pencil P. An "axis" indicates a center line extending in the forward/rearward direction of the pencil P, and the "axial direction" indicates a direction extending along the axis, which is the forward/rearward direction.

Figure 4A:
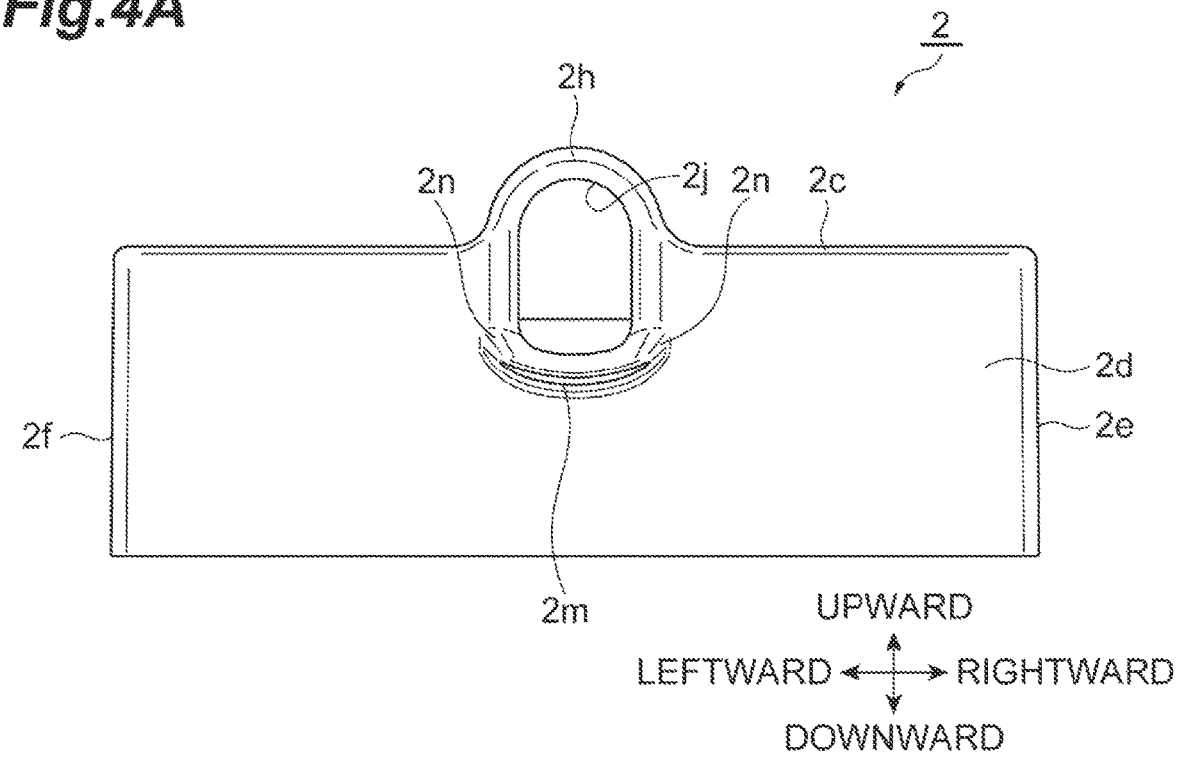
FIG. 4A is a front view illustrating a cover of the sharpener in FIG. 1.
Figure 4B:
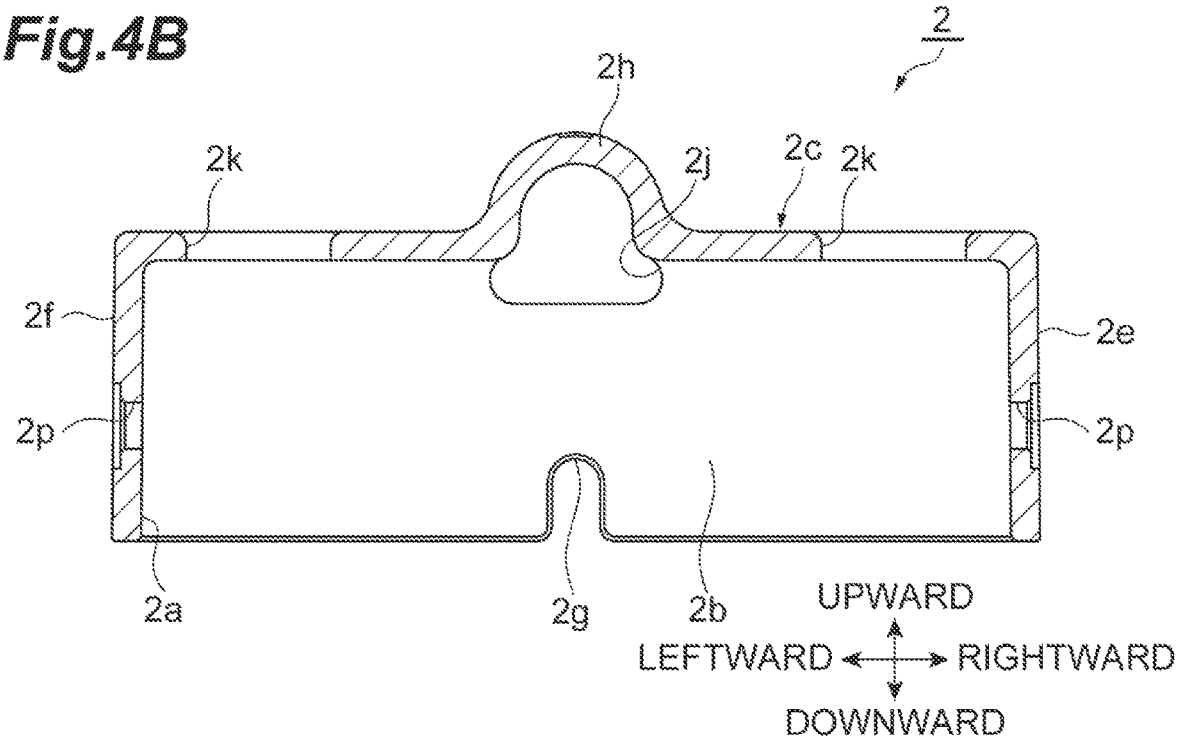
FIG. 4B is a sectional view taken along line B-B of the cover in FIG. 2A.

FIG. 4A is a front view of the cover 2 when viewed from the rear side. FIG. 4B is a sectional view taken along line B-B of the cover 2 in FIG. 2A. As illustrated in FIGS. 3, 4A, and 4B, the cover 2 has a substantially rectangular parallelepiped shape. The cover 2 is made of a transparent AS (SAN) resin. The transparent material is used for the cover 2 in this way. Accordingly, it is possible to visibly recognize a state of sharpening the pencil P inserted into the cover 2 and a scraping state of the pencil P. Furthermore, it is possible to adjust a degree of the pencil P in contact with the blade portion 3 by visibly recognizing the blade portion 3 inside the cover 2. It is possible to properly change a shape of the sharpened tip portion P3. The cover 2 has a bilaterally symmetrical shape.

A lower portion of the cover 2 includes a rectangular opening 2*a*. As an external configuration, the cover 2 includes a front portion 2*b*, an upper portion 2*c*, a rear portion 2*d*, a right-side portion 2*e*, and a left-side portion 2*f*, and the fixing member 4 is accommodated inside the cover 2 from the opening 2*a*. All of the front portion 2*b*, the upper portion 2*c*, the rear portion 2*d*, the right-side portion 2*e*, and the left-side portion 2*f* have a plate shape.

The front portion 2*b* has a rectangular shape extending long in the rightward/leftward direction. The front portion 2*b* includes a U-shaped recess portion 2*g* at the center of the front portion 2*b* in the rightward/leftward direction and at a lower end position. The recess portion 2*g* is disposed so as to prevent the cover 2 from being incorporated into the fixing member 4 in a state where front and rear positions of the cover 2 are reversely located. The upper portion 2*c* has a rectangular shape extending long in the rightward/leftward direction.

As illustrated in FIGS. 2A to 4B, the upper portion 2*c* includes a protruding portion 2*h* linearly extending in the forward/rearward direction at the center of the upper portion 2*c* in the rightward/leftward direction. An arrow 2*z* indicating the insertion direction of the pencil P is formed in the protruding portion 2*h*. For example, the arrow 2*z* may include a recessed shape formed in the protruding portion 2*h*. A guide hole 2*j* through which the pencil P passes is formed on a lower side of the protruding portion 2*h*. The guide hole 2*j* is formed so as to penetrate from the rear portion 2*d* to the front portion 2*b*.

One end of the guide hole 2*j* is disposed at the center of the front portion 2*b* in the rightward/leftward direction and at the upper position, and the other end of the guide hole 2*j* is disposed at the center of the rear portion 2*d* in the rightward/leftward direction and on the upper position. The guide hole 2*j* will be described in detail later. The upper portion 2*c* has a pair of through-holes 2*k* located next to both sides of the protruding portion 2*h* in the rightward/leftward direction. Each of the through-holes 2*k* has a longitudinally long oval shape extending in the forward/rearward direction. Although the scrapings of the pencil P are normally discharged downward, the scrapings of the pencil P which remains in the upper portion 4*d* of the fixing member 4 can be discharged by the through-holes 2*k*.

The rear portion 2*d* has a rectangular shape extending lengthwise in the rightward/leftward direction, and extending parallel to the front portion 2*b*. The rear portion 2*d* includes a protruding portion 2*m* protruding rearward on the lower side of the guide hole 2*j*. The protruding portion 2*m* is disposed so as to prevent the pencil P that is drawn rearward from the guide hole 2*j* from slipping and falling out of the guide hole 2*j*. When viewed from the rear side, the protruding portion 2*m* includes a pair of right and left curved portions 2*n* whose right and left sides are curved upward. Due to the curved portions 2*n*, a shape of the protruding portion 2*m* when viewed from the rear side is a gently curved U-shape. The shape of the protruding portion 2*m* is the U-shape in this way. Accordingly, the pencil P that is drawn out of the guide hole 2*j* can be located close to the center in the rightward/leftward direction. The pencil P is located close to the center of the guide hole 2*j* in the rightward/leftward direction. Therefore, the pencil P can be stably drawn out from the guide hole 2*j*.

The left-side portion 2*f* has a rectangular shape. The left-side portion 2*f* has a hole portion 2*p* into which a screw N1 is screwed so as to fix the cover 2 to the fixing member 4. The hole 2*p* is disposed at the center of the left-side portion 2*f* in the forward/rearward direction and on the lower side of the left-side portion 2*f*. A shape and a structure of the right-side portion 2*e* are the same as a shape and a structure of the left-side portion 2*f*, and thus, description thereof will be omitted.

Figure 5:
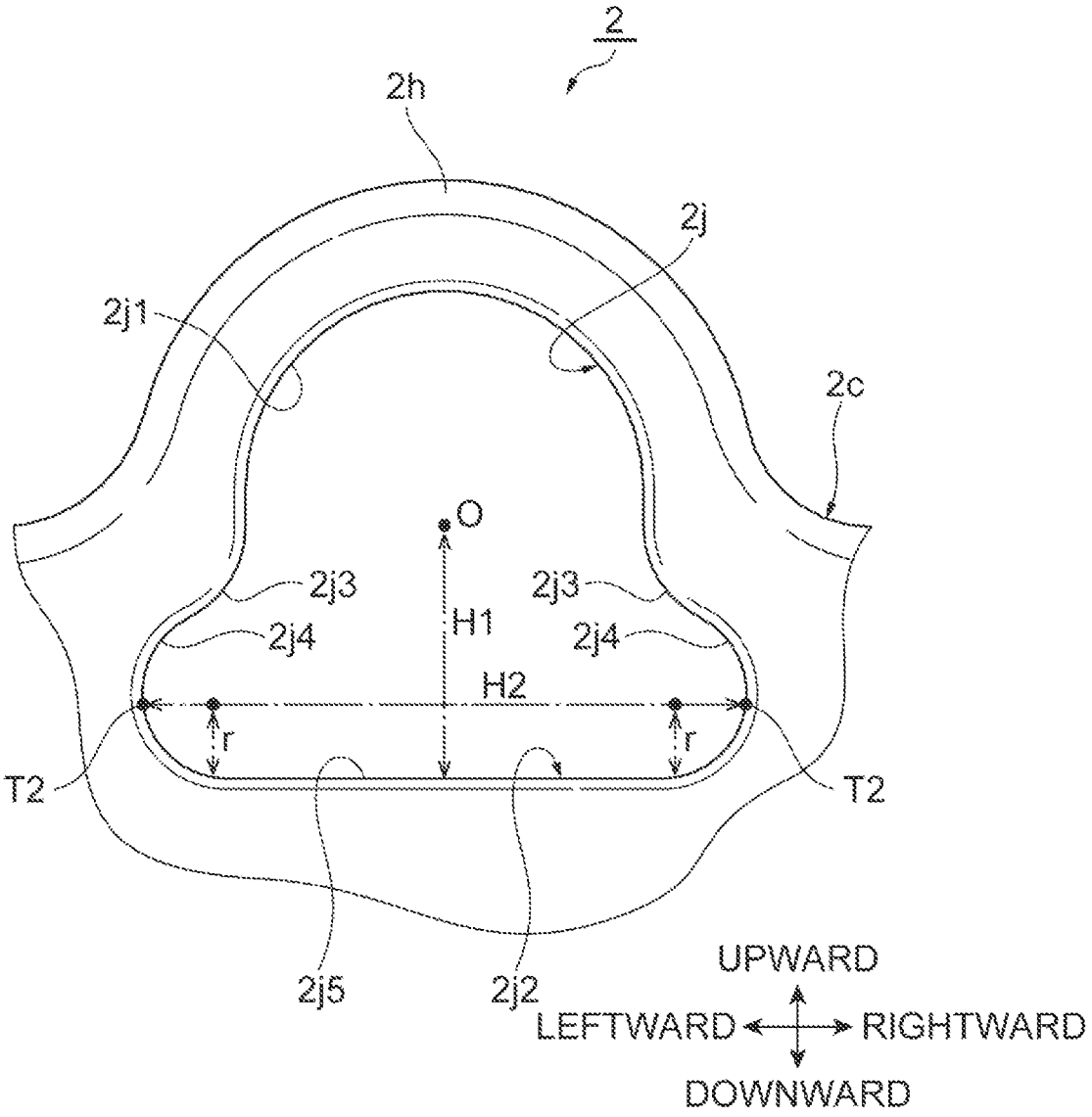
FIG. 5 is a front view illustrating a guide hole of the cover in FIGS. 4A and 4B.

FIG. 5 is a view when the guide hole 2*j* is viewed along the forward/rearward direction. As illustrated in FIG. 5, the guide hole 2*j* has a first inner peripheral portion 2*j*1 located on the upper side of the guide hole 2*j* and curved along the outer periphery of the pencil P, and a second inner peripheral portion 2*j*2 located on the lower side of the guide hole 2*j* and having a shape spread from the first inner peripheral portion 2*j*1 to the right and left end sides. A shape of the first inner peripheral portion 2*j*1 when viewed in the forward/rearward direction is an arc shape, and forms a semicircular shape.

The second inner peripheral portion 2*j*2 has a first arc-shaped curved portion 2*j*3 curved to both the right and left end sides from a connecting portion formed by the first inner peripheral portion 2*j*1 and having centers of rotation located outside of the guide hole 2*j* on both the right and left sides, a second semicircular curved portion 2*j*4 extending from both the right and left ends of the first curved portion 2*j*3 and having a centers of rotation located inside of the guide hole 2*j* in the rightward/leftward direction, and a linear portion 2*j*5 for connecting lower ends of a pair of right and left second curved portions 2*j*4 to each other.

An outer diameter (diameter) of the pencil P is 7.65 mm, and the diameter of the first inner peripheral portion 2*j*1 is 7.90 mm. A distance H1 from a center O of the guide hole 2*j* to the linear portion 2*j*5 is 5.75 mm. A radius of curvature r associated with the centers of rotation of the second curved portion 2*j*4 is 1.69 mm. A distance H2 between end portions T2 on both the right and left end sides of the second curved portion 2*j*4 is 12.00 mm.

The respective dimensions of the first inner peripheral portion 2*j*1 and the second inner peripheral portion 2*j*2 of the guide hole 2*j* are set as described above. In this manner, the pencil P is guided along an arc portion of the first inner peripheral portion 2*j*1, and the second inner peripheral portion 2*j*2 has a spreading shape. Accordingly, it is possible to minimize the amount of contact between the pencil P and the inner wall of the guide hole 2*j*.

Figure 6A:
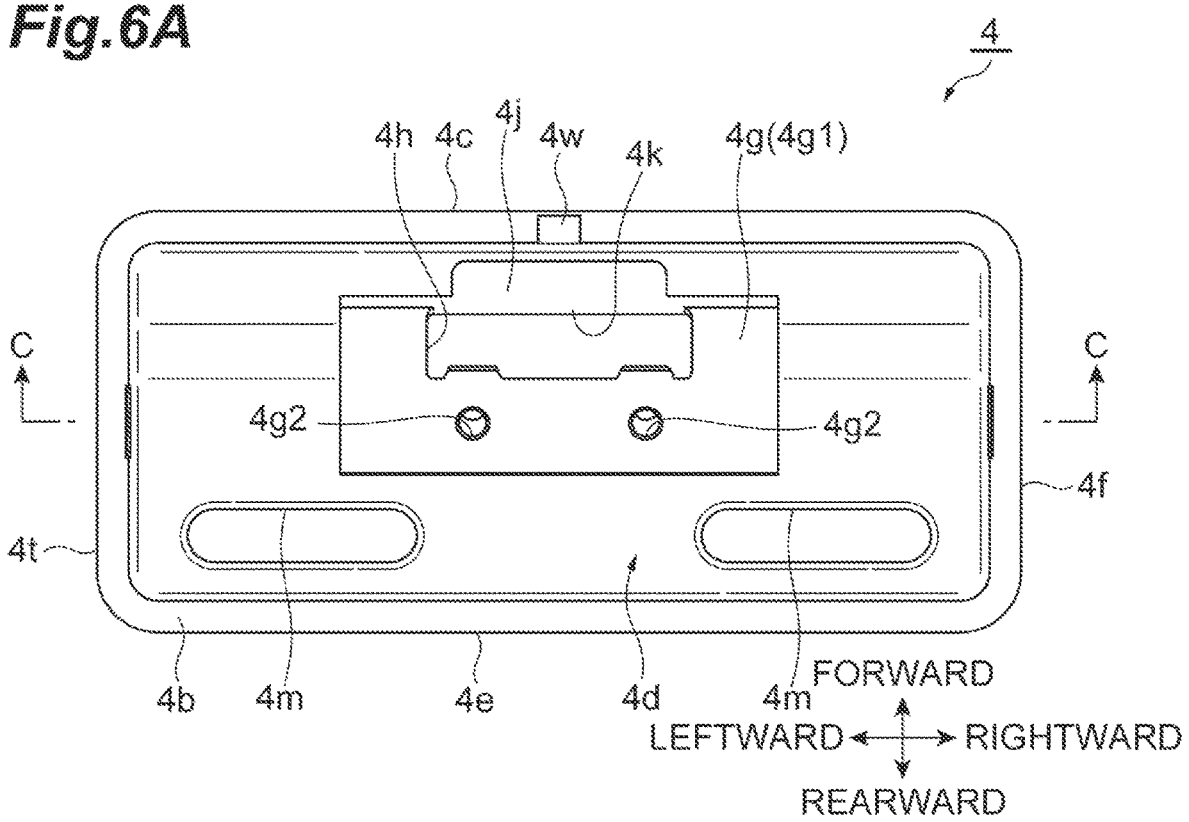
FIG. 6A is a plan view illustrating a fixing member of the sharpener in FIG. 1.
Figure 6B:
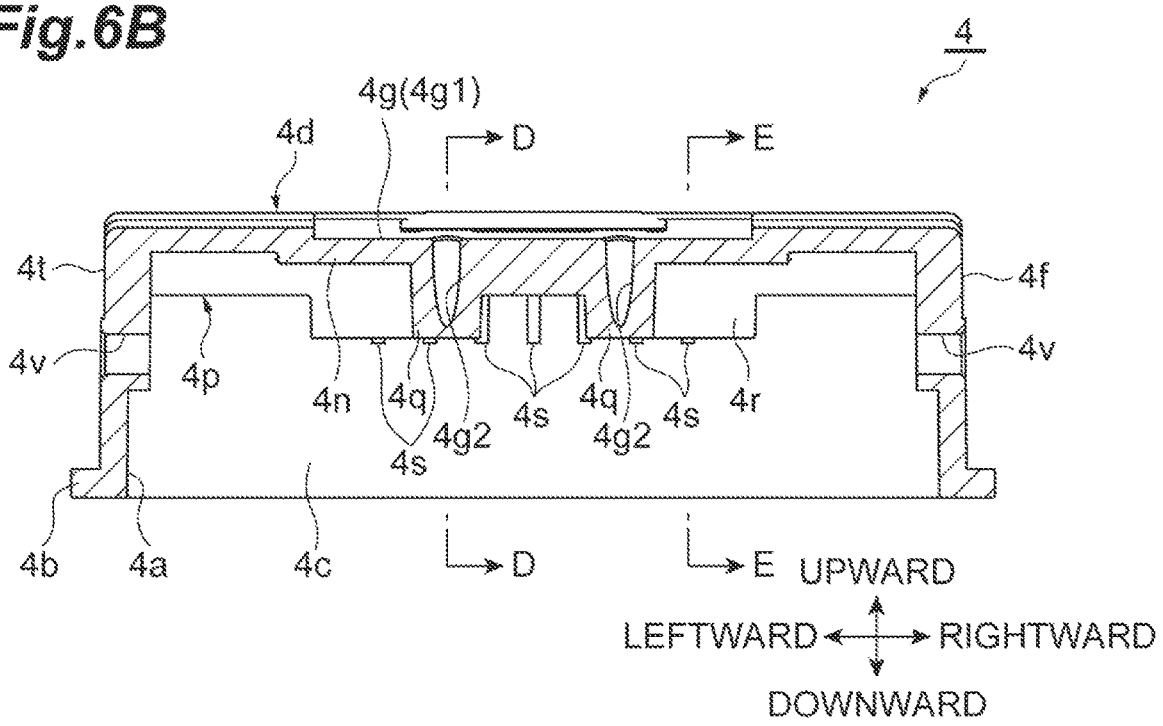
FIG. 6B is a sectional view taken along line C-C in FIG. 6A.
Figure 7B:
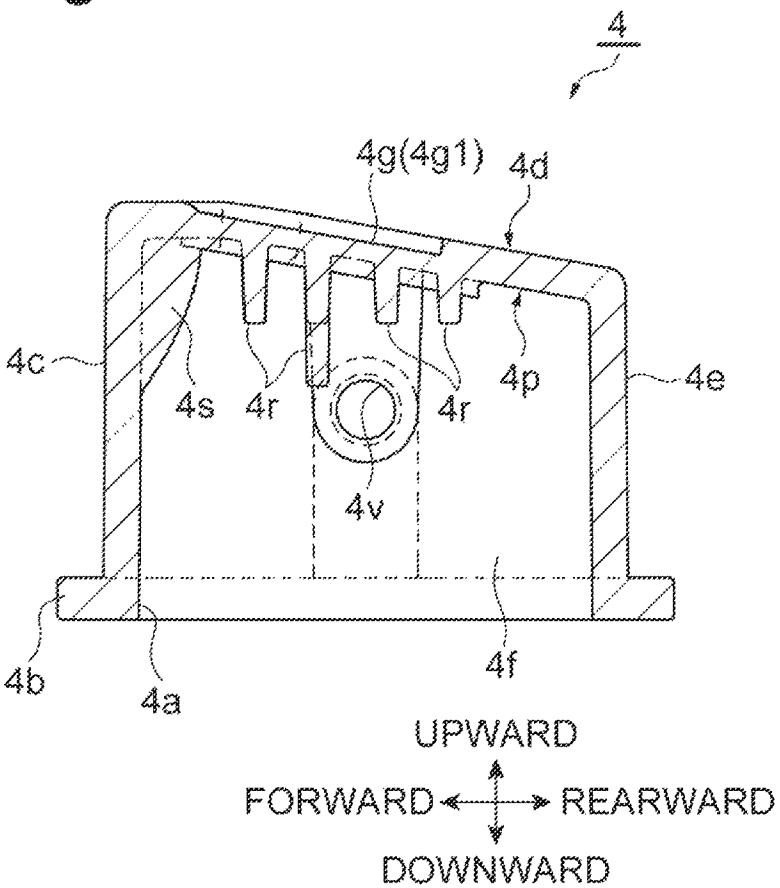
FIG. 7B is a sectional view taken along line E-E in FIG. 6B.
Figure 7A:
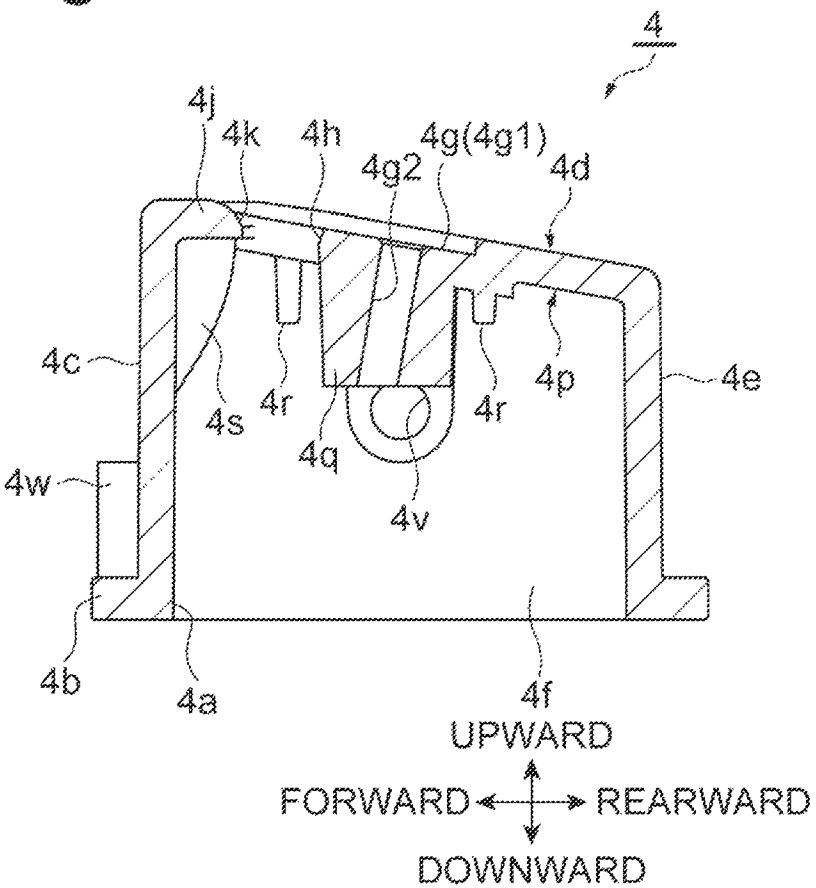
FIG. 7A is a sectional view taken along line D-D in FIG. 6B.

FIG. 6A is a plan view illustrating the fixing member 4. FIG. 6B is a sectional view taken along line C-C in FIG. 6A. FIG. 7A is a sectional view taken along line D-D in FIG. 6B. FIG. 7B is a sectional view taken along line E-E in FIG. 6B. As illustrated in FIGS. 6A, 6B, 7A, and 7B, the fixing member 4 has a rectangular parallelepiped shape having an inclined upper surface. The fixing member 4 is made of a colored ABS resin, and has a bilaterally symmetrical shape.

The fixing member 4 includes a rectangular opening 4*a* in a lower portion thereof and a rectangular spreading portion 4*b* spreading outward of the fixing member 4 in an outer edge of the opening 4*a*. As an external configuration, the fixing member 4 includes a front portion 4*c*, an upper portion 4*d*, a rear portion 4*e*, a right-side portion 4*f*, and a left-side portion 4*t*. The scrapings of the pencil P are accumulated inside the opening 4*a*.

The front portion 4*c* has a rectangular shape extending lengthwise in the rightward/leftward direction, and the rear portion 4*e* has a rectangular shape extending parallel to the front portion 4*c*. The front portion 4*c* has a U-shaped projection portion 4*w* at the center in the rightward/leftward direction and at a lower end position. The projection portion 4*w* is fitted into the recess portion 2*g* of the cover 2. The projection portion 4*w* is fitted into the recess portion 2*g*, thereby positioning the cover 2 with respect to the fixing member 4.

A height of the front portion 4*c* (distance in the upward/downward direction) relative to the spreading portion 4*b* at the lower end of the fixing member 4 is higher than a height of the rear portion 4*e* relative to the spreading portion 4*b*. The upper portion 4*d* is obliquely inclined downward from the upper end of the front portion 4*c* toward the upper end of the rear portion 4*e*. An inclination angle of the upper portion 4*d* with respect to the forward/rearward direction is in a range of 8.5° to 10.5°, for example. However, the inclination angle of the upper portion 4*d* can be appropriately changed depending on the diameter of the pencil P.

As illustrated in FIG. 3, the inclination angle of the upper portion 4*d* is set to be a value close to the inclination angle of the upper surface of the protruding portion 2*m* of the cover 2, and the upper surfaces of the upper portion 4*d* and the protruding portion 2*m* are arranged so as to be continuous with each other. The upper portion 4*d* and the upper surface of the protruding portion 2*m* are smoothly continuous with each other in this way. Accordingly, it is possible to pull the pencil P without interference from the guide hole 2*j*. Therefore, it is possible to efficiently sharpen the pencil P by smoothly inserting and removing the pencil P into and from the guide hole 2*j*.

As illustrated in FIGS. 6A, 6B, 7A, and 7B, the upper portion 4*d* of the fixing member 4 has a recess-shaped incorporation portion 4*g* which positions and incorporates the blade portion 3 into a center portion of the upper portion 4*d* in the rightward/leftward direction. The incorporation portion 4*g* has a shape conforming to the blade portion 3, and the blade portion 3 is positioned in the recess-shaped incorporation portion 4*g*, thereby positioning the blade portion 3.

The incorporation portion 4*g* has a bottom surface 4*g*1 having a rectangular outer shape. The bottom surface 4*g*1 is inclined together with the upper surface of the upper portion 4*d*. A pair of screw holes 4*g*2 into which a screw N2 (refer to FIG. 8) for fixing the blade portion 3 to the fixing member 4 is screwed is formed on the bottom surface 4*g*1. In this way, the bottom surface 4*g*1 may have the screw hole 4*g*2 in advance. Only a hole may be initially disposed, and the screw hole 4*g*2 may be formed by screwing the screw N2. A through-hole 4*h* penetrating in the upward/downward direction is formed on the center of the front side of the bottom surface 4*g*1 in the rightward/leftward direction. The through-hole 4*h* has a rectangular shape extending lengthwise in the rightward/leftward direction. The through-hole 4*h* is disposed for passing the scrapings of the pencil P downward.

A contact portion 4*j* with which the pencil P comes into contact is disposed on the front side of the through-hole 4*h*. The height of the contact portion 4*j* is the same as the height of the upper end of the front portion 4*c*, and is located higher than the blade portion 3 incorporated in the incorporation portion 4*g*. The contact portion 4*j* is not inclined like other portions of the upper portion 4*d*, and extends in the forward/rearward direction and the rightward/leftward direction.

The rear side (the through-hole 4*h* side) of the contact portion 4*j* is a curved portion 4*k* curved downward. The curved portion 4*k* enables a smooth release of the pencil P as it is separated from the contact portion 4*j*. The curved portion 4*k* is curved in an arc shape, for example. A pair of right and left through-holes 4*m* are formed on the rear side of the incorporation portion 4*g* and on both end sides of the upper portion 4*d* in the rightward/leftward direction. Each of the through-holes 4*m* has an oval shape extending lengthwise in the rightward/leftward direction. The through-hole 4*m* enables the scrapings remaining in the upper portion 4*d* of the fixing member 4 to be discharged downward.

A step portion 4*n* conforming to the shape of the incorporation portion 4*g* is formed in the inner portion 4*p* of the upper portion 4*d*. The step portion 4*n* allows the thickness of the fixing member 4 to be uniform in the portion of the incorporation portion 4*g*. The inner portion 4*p* has a pair of right and left protruding portions 4*q* having a screw hole 4*g*2 formed therein and protruding inward of the fixing member 4, a plurality of first ribs 4*r* protruding inward of the fixing member 4 and extending in the rightward/leftward direction, and a plurality of second ribs 4*s* protruding downward at the front end and the upper end of the fixing member 4 and curved forward.

The plurality of first ribs 4*r* are juxtaposed with each other in the forward/rearward direction. For example, four first ribs 4*r* are juxtaposed at equal intervals. The first rib 4*r* in the second order from the front side protrudes downward so as to be longer than the other first ribs 4*r*. The plurality of second ribs 4*s* are juxtaposed with each other in the rightward/leftward direction.

For example, seven second ribs 4*s* are juxtaposed with each other at equal intervals, and shapes and sizes of the seven second ribs 4*s* are the same as each other. The fixing member 4 is reinforced by disposing the plurality of first ribs 4*r*. The first ribs 4*r* and the second ribs 4*s* which protrude long can prevent a finger from entering the through-hole 4*h* from below.

The right-side portion 4*f* of the fixing member 4 has a trapezoidal shape including a leg portion inclined downward from the front side of the fixing member 4 to the rear side. The right-side portion 4*f* has a screw hole 4*v* into which a screw N1 (refer to FIG. 8) is screwed via the hole portion 2*p* of the cover 2. In this way, the screw hole 4*v* may be disposed in the right-side portion 4*f* in advance. Alternatively, only a hole may be initially disposed, and the screw hole 4*v* may be formed by screwing the screw N1. The screw hole 4*v* is disposed near the center of the right-side portion 4*f*. A shape and a structure of the left-side portion 4*t* are the same as a shape and a structure of the right-side portion 4*f*, and thus, description thereof will be omitted.

Figure 8:
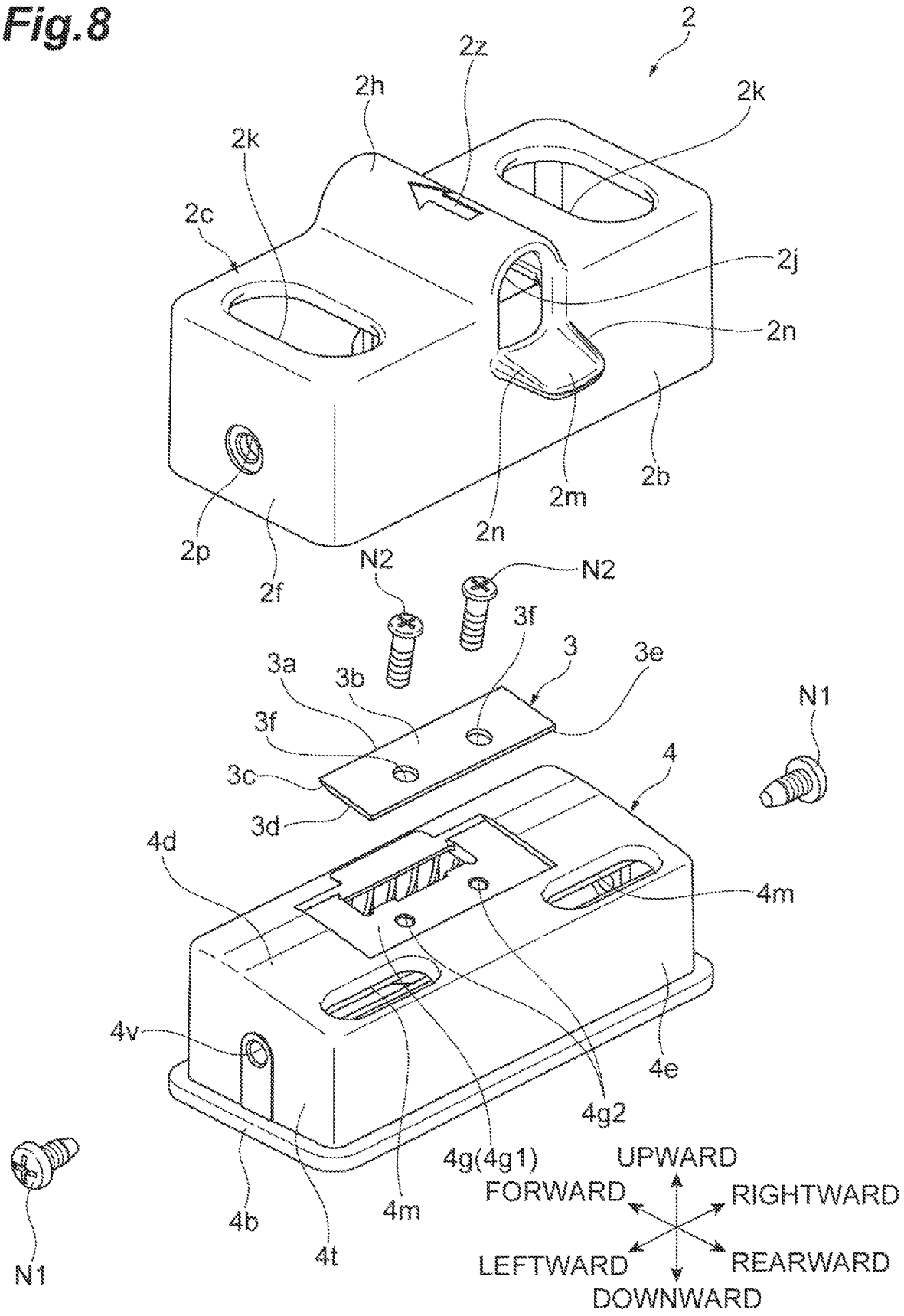
FIG. 8 is an exploded perspective view of the sharpener in FIG.
Figure 9:
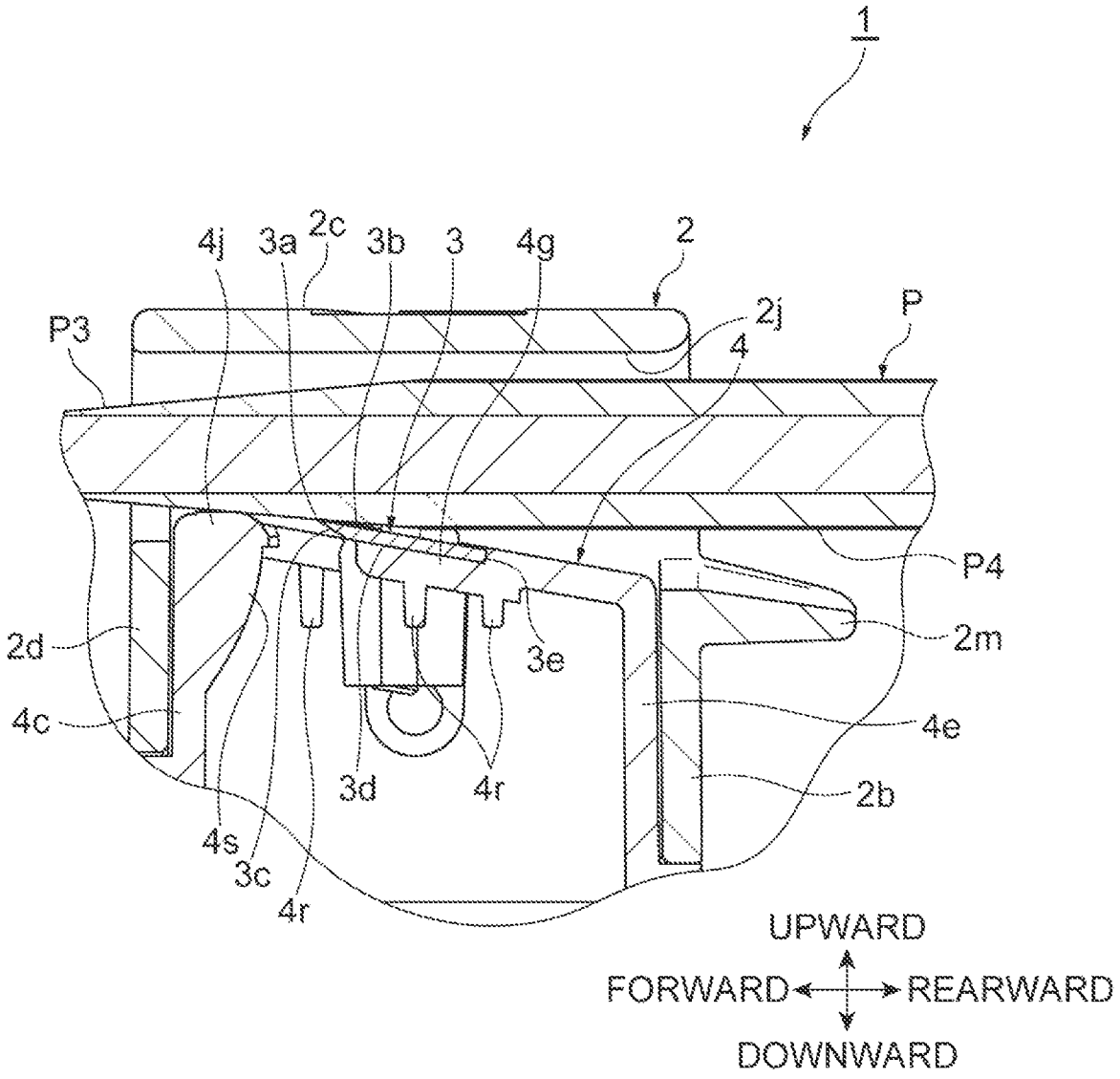
FIG. 9 is an enlarged sectional view of a blade portion, a contact portion, and the guide hole of the sharpener in FIG. 3.

FIG. 8 is an exploded perspective view of the sharpener 1. FIG. 9 is an enlarged sectional view of the guide hole 2*j* in FIG. 3. As described above, the blade portion 3 is fixed to the fixing member 4 by being incorporated in the incorporation portion 4*g* of the fixing member 4. As illustrated in FIGS. 8 and 9, the blade portion 3 has a plate shape extending lengthwise in the rightward/leftward direction, and includes a sharp blade edge 3*a* extending in the rightward/leftward direction.

The blade portion 3 has a first surface 3*b* extending from the blade edge 3*a*, a second surface 3*c* forming an acute angle with respect to the first surface 3*b* and having an area smaller than that of the first surface 3*b*, a third surface 3*d* extending parallel to the first surface 3*b*, a fourth surface 3*e* extending perpendicular to both the first surface 3*b* and the third surface 3*d* and located between the first surface 3*b* and the third surface 3*d*.

The blade portion 3 is fixed to the incorporation portion 4*g* in a state where the blade edge 3*a* faces forward and the larger first surface 3*b* faces upward. In a state where the blade portion 3 is fixed to the incorporation portion 4*g*, the blade portion 3 is inclined downward as the blade portion 3 goes rearward. That is, the blade portion 3 is inclined downward in a direction in which the acute angle (for example, an angle of 8.5° to 10.5°) is formed with respect to the axial direction of the pencil P.

The blade portion 3 has a pair of right and left through-holes 3*f* into which the screw N2 is inserted. In a state where the blade portion 3 is incorporated in the incorporation portion 4*g*, the screw N2 is inserted into each through-hole 3*f*. The screw N2 is screwed into the screw hole 4*g*2 of the incorporation portion 4*g*. In this manner, the blade edge 3*a* protrudes forward from the incorporation portion 4*g*, and the blade portion 3 is fixed in a state where the blade portion 3 is inclined downward as the blade portion 3 goes rearward.

A method of assembling the sharpener 1 configured as described above will be described. First, the blade portion 3 is fixed to the fixing member 4. Specifically, the blade portion 3 is incorporated in the incorporation portion 4*g* of the fixing member 4, and the screw N2 is inserted from above into the through-hole 3*f* of the blade portion 3 and the screw hole 4*g*2 of the fixing member 4. The screw N2 is screwed into the screw hole 4*g*2, and the blade portion 3 is fixed to the fixing member 4.

Subsequently, the cover 2 is covered from above the fixing member 4, and the fixing member 4 is accommodated in the cover 2. Specifically, a direction of the projection portion 4*w* of the fixing member 4 is aligned with a direction of the recess portion 2*g* of the cover 2, and the forward/rearward directions of the fixing member 4 and the cover 2 are aligned with each other. The cover 2 is disposed above the fixing member 4 in a state where the opening 2*a* of the cover 2 faces downward, and the cover 2 is lowered to the fixing member 4. An outer portion of the opening 2*a* of the cover 2 is placed on the spreading portion 4*b* of the fixing member 4. In this state, the screw N1 is inserted into the hole 2*p* of the cover 2 and the screw hole 4*v* of the fixing member 4 from both the right and left end sides, and the screw N1 is screwed into the screw hole 4*v*, thereby fixing the cover 2 to the fixing member 4. As described above, it is possible to easily assemble the sharpener 1. Without using the screw N1, it is also possible to forcibly press fit and fix the cover 2 into the fixing member 4. Alternatively, it is possible to detachably incorporate the cover 2 into the fixing member 4 by means of snap fitting.

Next, an operation of each portion of the sharpener 1 when the pencil P is sharpened will be described. First, the sharpener 1 is disposed in a state where the opening 2*a* of the cover 2 and the opening 4*a* of the fixing member 4 face downward. For example, in a state where the sharpener 1 is held with one hand, as illustrated in FIGS. 2A, 2B, and 3, the pencil P is inserted into the guide hole 2*j* of the cover 2 from the outside of the sharpener 1. When the pencil P is inserted and the pencil P is pulled rearward in a state where the tip portion P3 of the pencil P protrudes outward, the pencil P is sharpened by the blade portion 3.

Figure 10:
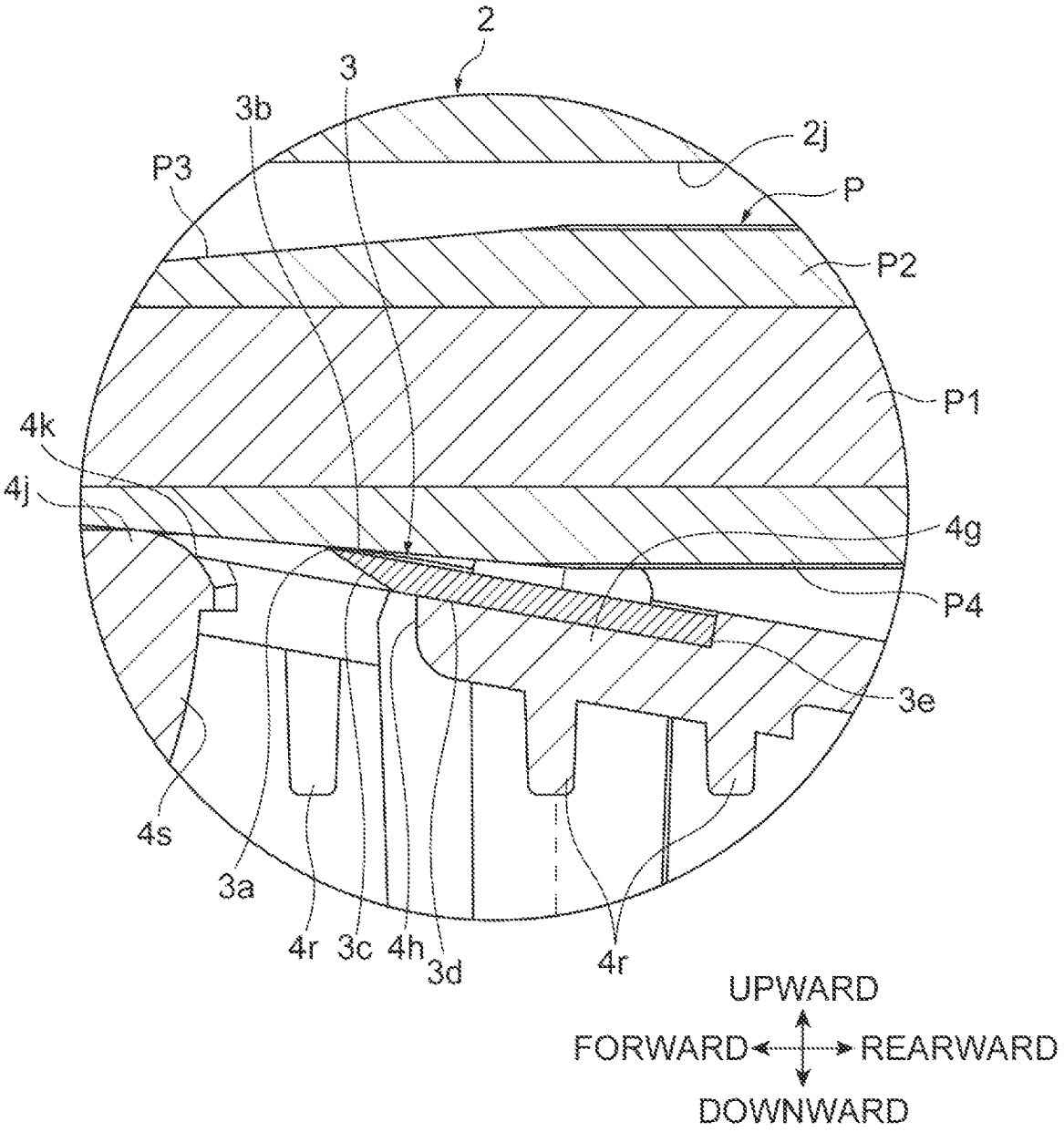
FIG. 10 is a further enlarged sectional view of the blade portion in FIG. 9.

However, as illustrated in FIGS. 9 and 10, the contact portion 4*j* of the fixing member 4 is located ahead of and above the blade edge 3*a* of the blade portion 3. Accordingly, the contact portion 4*j* comes into contact with the side surface portion P4 of the pencil P extending parallel to the forward/rearward direction, and the blade edge 3*a* does not come into contact with the side surface portion P4. Therefore, even if the pencil P is pulled rearward, the side surface portion P4 is not sharpened. The side surface portion P4 indicates a portion other than the tip portion P3.

In contrast, when the pencil P is pulled rearward, the tip portion P3 of the pencil P is located behind the contact portion 4*j*, and does not come into contact with the contact portion 4*j*. Accordingly, the blade edge 3*a* comes into contact with the tip portion P3. Therefore, if the pencil P is pulled rearward, the blade edge 3*a* cuts into one side of the pencil P in the radial direction of the tip portion P3.

Figure 11A:
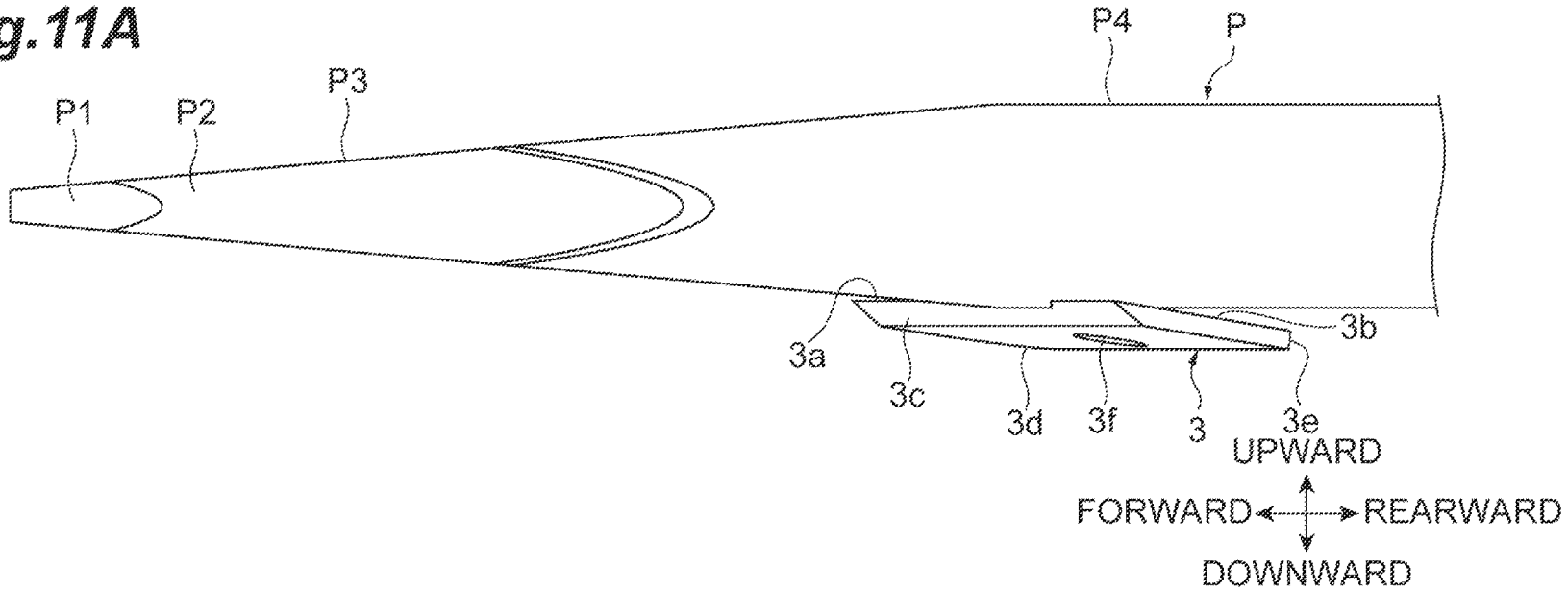
FIG. 11A is a perspective view illustrating a, state where the blade portion starts to sharpen the pencil.
Figure 11B:
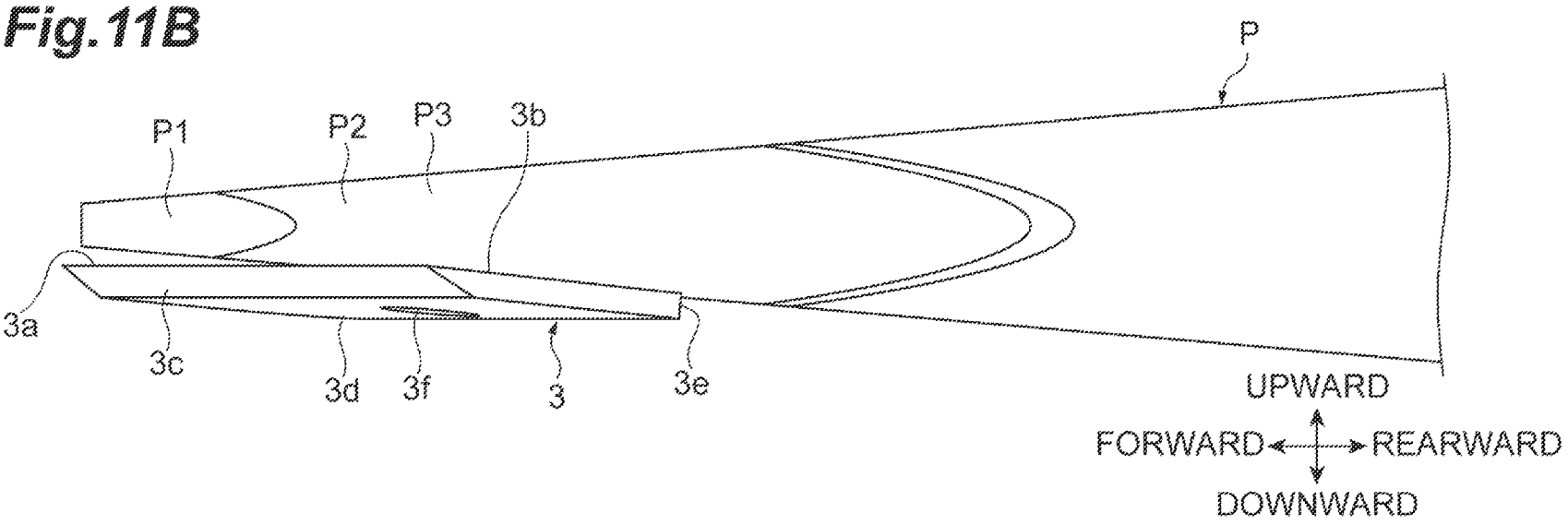
FIG. 11B is a perspective view illustrating a state where the blade portion sharpens the pencil.

As illustrated in FIGS. 11A and 11B, if the pencil P is pulled rearward, the blade edge 3*a* moves forward relative to the pencil P and inward in the radial direction of the pencil P. At this time, the blade edge 3*a* linearly moves in the direction in which the blade edge 3*a* is inclined by forming the acute angle with respect to the axial direction. Therefore, while the blade edge 3*a* cuts into the pencil P, the blade edge 3*a* sharpens both the lead P1 and the covering portion P2 of the pencil P in a planar manner while facing forward and upward relative to the pencil P.

Figure 12A:
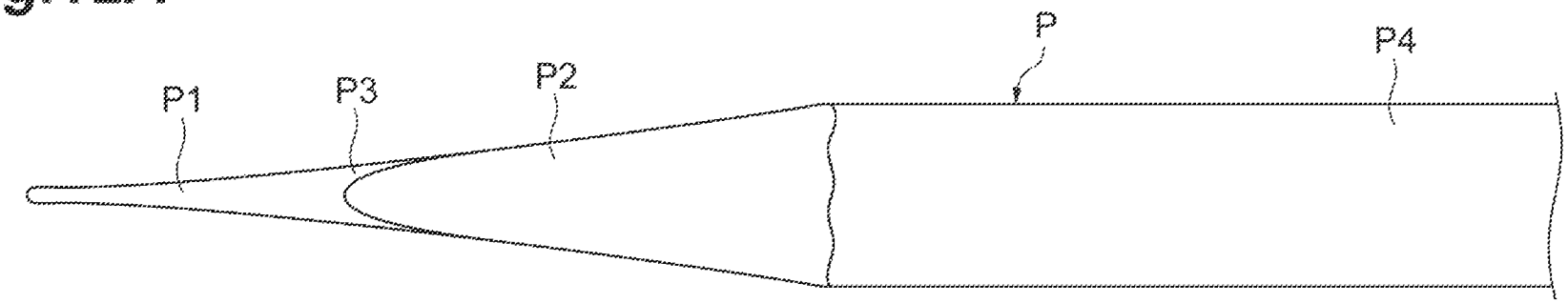
FIG. 12A is a side view illustrating an eyebrow pencil having a long sword shape.
Figure 12B:
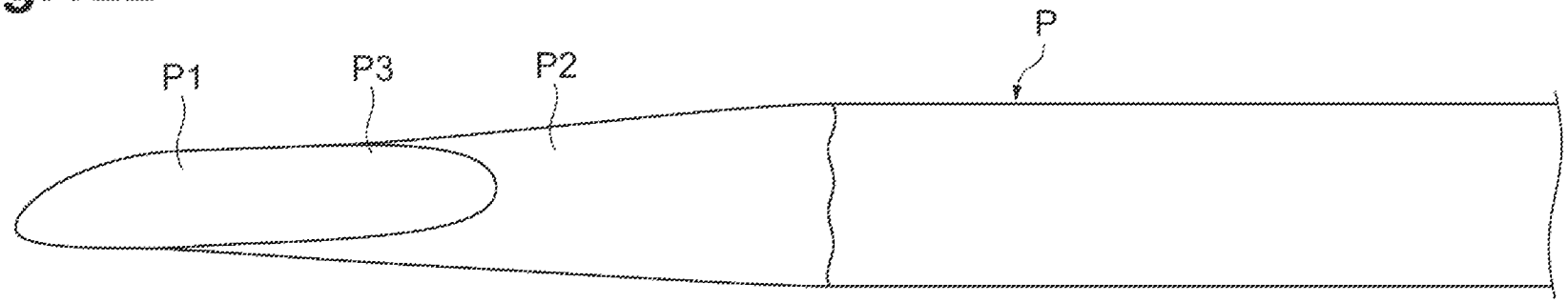
FIG. 12B is a side view illustrating an eyebrow pencil having a long sword shape.

As described above, the blade portion 3 sharpens the tip portion P3 of the pencil P along a plane inclined with respect to the axial direction of the pencil P. That is, the pencil P is sharpened into a shape having a planar portion inclined toward one side of the pencil P in the radial direction. If pencil P is inserted into and removed from the guide hole 2*j* by inserting the pencil P upside down, the pencil P is sharpened into a long sword shape having the planar portions respectively inclined to both sides in the radial direction. In this way, after the pencil P is sharpened in the long sword shape, a producer of the pencil P carries out final finishing work with a cutter or the like so that the shape of the tip portion P3 becomes a desired shape. For example, in the final finishing work, as illustrated in FIGS. 12A and 12B, it is possible to easily produce the pencil P having the long sword shape optimized for an eyebrow pencil.

Figure 13A:
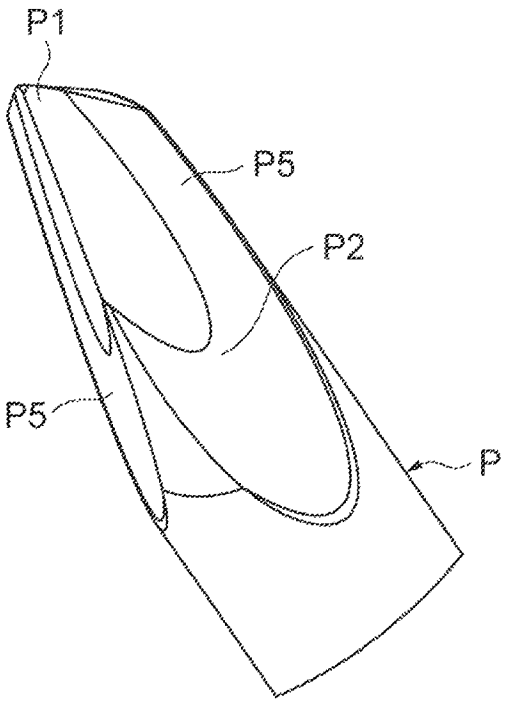
FIG. 13A is a perspective view illustrating a tip portion of a pencil having a planar cutting surface formed therein and including an acute angle portion of a drawing material.
Figure 13B:
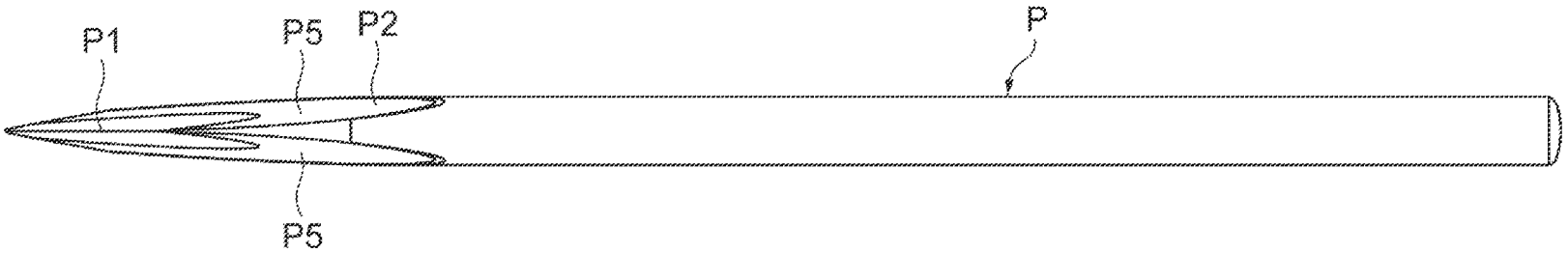
FIG. 13B is a side view illustrating the pencil in FIG. 13A.
Figure 14A:
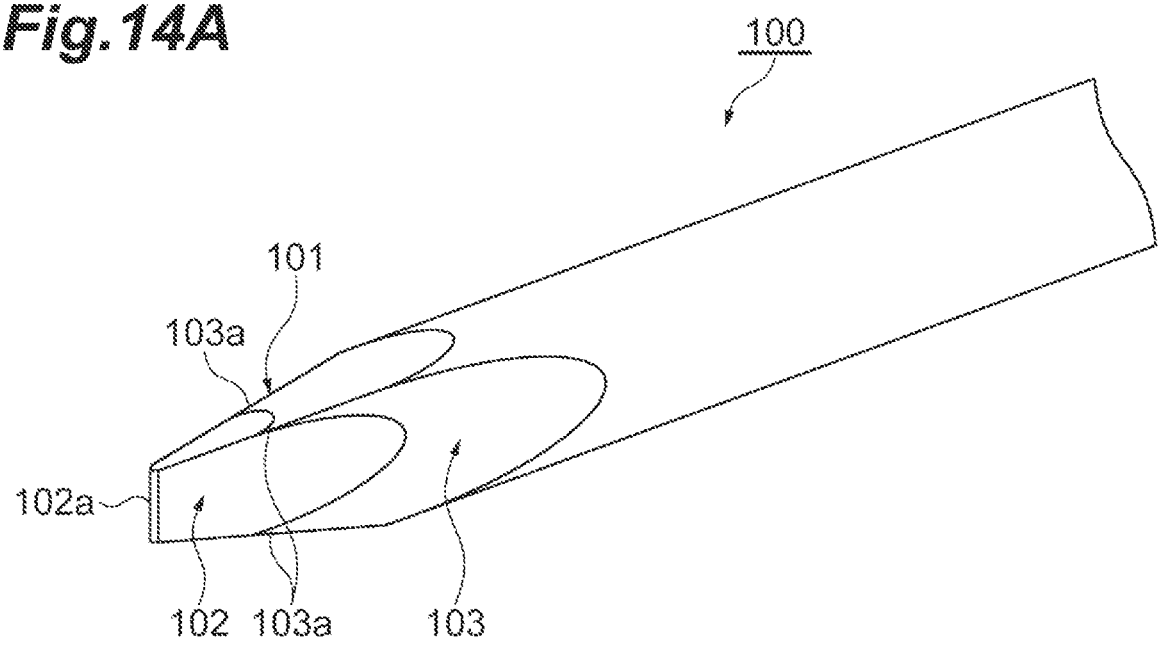
FIG. 14A is a perspective view illustrating a pencil having a long sword shape.
Figure 14B:
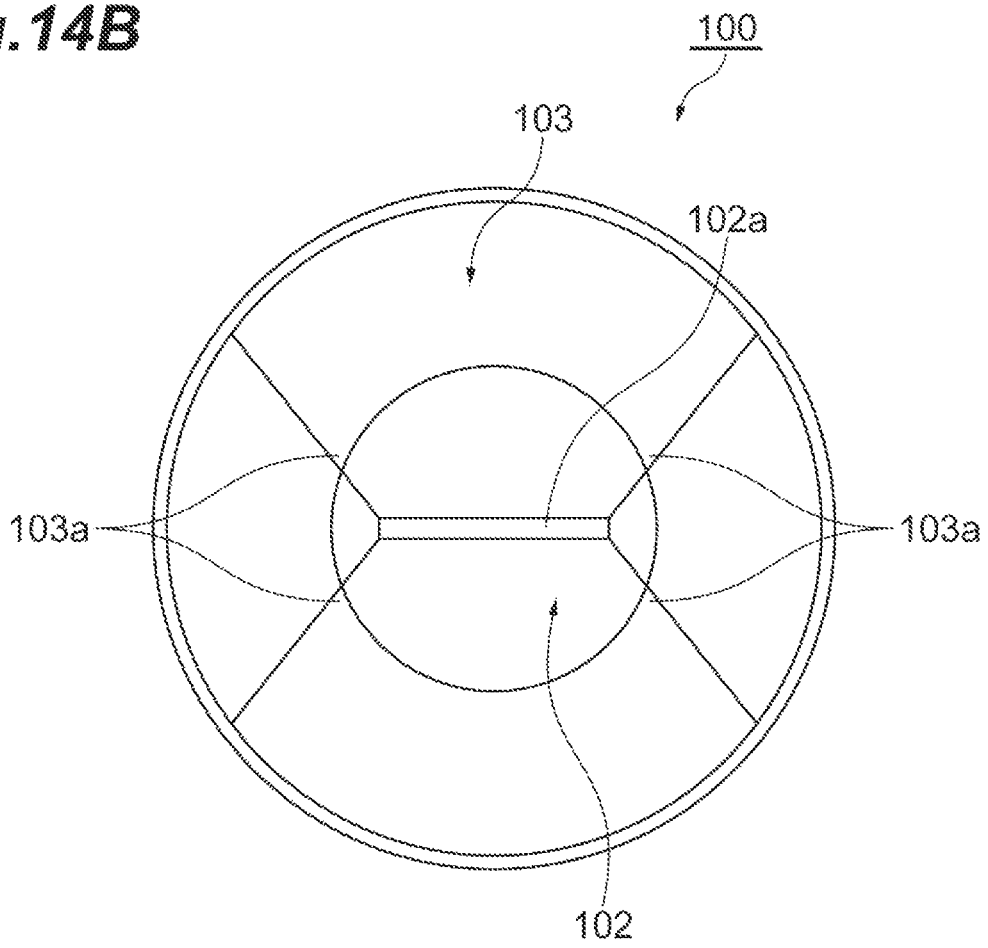
FIG. 14B is a front view illustrating the pencil in FIG. 14A.

It is also possible to sharpen the pencil P in a shape different from the above-described shape. For example, the pencil P can be finished into a shape illustrated in FIGS. 13A and 13B by adjusting a contact degree between the pencil P and the blade portion 3 while the pencil P is rotated. The pencil P illustrated in FIGS. 13A and 13B has a plurality of planar cutting surfaces P5 (planar portions), and an acute angle portion is formed in the lead P1. Therefore, the pencil P can be used as an eyebrow makeup pencil so that a thin line is easily drawn by the lead P1, and it is possible to easily cut the shape of the pencil P.

Next, an operation effect of the sharpener 1 according to one or more embodiments will be described in detail. As illustrated in FIG. 3, the pencil P inserted into the main body 1A of the sharpener 1 is guided to the blade portion 3 by the guide hole 2*j* formed in the main body 1A. The tip portion P3 of the pencil P guided by the guide hole 2*j* reaches the blade portion 3, and the blade portion 3 comes into contact with the tip portion P3 of the pencil P, thereby sharpening the tip portion P3 of the pencil P. The pencil P slides in the guide hole 2*j* in the axial direction, and the blade portion 3 sharpens the tip portion P3 along a plane inclined with respect to the axial direction. Accordingly, the planar portion extending along the plane and inclined with respect to the axial direction is formed in the tip portion P3 of the pencil P.

Therefore, since the tip portion P3 of the pencil P is inserted into the guide hole 2*j*, it is possible to promptly produce the pencil P having the planar portion formed therein. Accordingly, this type of the pencil P can be easily produced. It is possible to reduce efforts in sharpening the pencil P by using a cutter held with a producer's hand. Therefore, it is possible to suppress uneven quality of the pencil P.

The sharpener 1 includes the contact portion 4*j* which comes into contact with the inserted pencil P and separates a portion of the pencil P (e.g., the side surface portion P4), other than the tip portion P3, from the blade edge 3*a* of the blade portion 3. Therefore, since the contact portion 4*j* comes into contact with the pencil P, it is possible to prevent the blade edge 3*a* of the blade portion 3 from coming into contact with the portion of the pencil P other than the tip portion P3. Accordingly, it is possible to prevent the other portion of the pencil P from being sharpened.

The main body 1A includes the fixing member 4 to which the blade portion 3 is fixed, and the cover 2 accommodating the fixing member 4 and having the guide hole 2*j* formed therein. Therefore, the guide hole 2*j* guides the tip portion P3 of the pencil P to the blade portion 3, and brings the tip portion P3 of the pencil P into contact with the fixed blade portion 3. Since the blade portion 3 is fixed to the fixing member 4, the tip portion P3 can be more reliably brought into contact with the blade portion 3.

That is, the position of the blade portion 3 can be stabilized, and the tip portion P3 of the pencil P can more reliably brought into contact with the blade portion 3. Accordingly, the tip portion P3 of the pencil P can be more smoothly sharpened. In particular, in a case where the pencil P is pulled while being pressed against the blade portion 3 side (lower side) after the pencil P is inserted into the guide hole 2*j*, the sharpened amount can be increased. Therefore, the tip portion P3 can be more smoothly sharpened.

Furthermore, the main body 1A is configured to include two components of the cover 2 and the fixing member 4. Accordingly, the tip portion P3 can be smoothly sharpened using a small number of components. In a case where the covering portion P2 of the pencil P is made of wood, the hardness (cutting strength) may be uneven depending on the position of the wood. Even in this case, in the sharpener 1, the pencil P is sharpened using the fixed blade portion 3. Therefore, the pencil P can be reliably and securely sharpened by minimizing the above-described uneven hardness.

As illustrated in FIG. 10, the blade portion 3 has the first surface 3*b* extending from the blade edge 3*a*, and the second surface 3*c* forming the acute angle with respect to the first surface 3*b* and having a smaller area than that of the first surface 3*b*. That is, the first surface 3*b* and the second surface 3*c* correspond to a blade surface extending from the blade edge 3*a* in a direction which is inclined with respect to the axial direction. The blade portion 3 is installed so that the second surface 3*c* faces away from the pencil P. Accordingly, the upper side (first surface 3*b*) of the acute angle portion of the blade edge 3*a* of the blade portion 3 faces the pencil P. Thus, a configuration can be adopted in which the blade edge 3*a* is likely to cut into the pencil P. Therefore, compared to a case where the lower side (second surface 3*c*) of the acute angle portion of the blade edge 3*a* faces the pencil P, the tip portion P3 of the pencil P can be more smoothly sharpened.

The pencil P has the lead P1 and the covering portion P2 for covering the lead P1. The blade portion 3 sharpens both the lead P1 and the covering portion P2 of the inserted pencil P. Therefore, the tip portion P3 of the pencil P is brought into contact with the blade portion 3, thereby enabling both the lead P1 and the covering portion P2 to be sharpened. Accordingly, the tip portion P3 of the pencil P can be effectively sharpened.

As illustrated in FIG. 5, the guide hole 2*j* has the first inner peripheral portion 2*j*1 shaped along the outer periphery of the pencil P on the side (upper side) of the guide hole 2*j* opposite to the blade portion 3, and the second inner peripheral portion 2*j*2 located on the blade portion 3 side (lower side) of the guide hole 2*j* has a shape spreading from the first inner peripheral portion 2*j*1. Therefore, since the guide hole 2*j* includes the first inner peripheral portion 2*j*1 shaped along the outer periphery of the pencil P on the side opposite to the blade portion 3, movement of the pencil P in the radial direction can be regulated or minimized when the pencil P is inserted into the guide hole 2*j*. Accordingly, since the pencil P can be inserted into the guide hole 2*j* in a stabilized manner, the tip portion P3 of the pencil P can be smoothly sharpened.

The guide hole 2*j* includes the second inner peripheral portion 2*j*2 located on the blade portion 3 and having the shape spreading with respect to the first inner peripheral portion 2*j*1. In this manner, even if the position of the pencil P inserted into the guide hole 2*j* is inclined in the axial direction, it is possible to minimize the amount of contact between the pencil P and the inner wall surface of the guide hole 2*j*. That is, in a case where the entire inner periphery of the guide hole has a shape P (for example, a perfect circle) extending along the outer periphery of the pencil P, the pencil P may come into contact with the wall surface of the guide hole when the pencil P is inserted into the guide hole. Consequently, in some cases, the pencil P cannot be efficiently sharpened.

In contrast, as described above, in a case where the guide hole 2*j* includes the spread second inner peripheral portion 2*j*2, even if the pencil P is inclined, a configuration can be adopted in which the contact between the pencil P and the wall surface of the guide hole 2*j* is minimized. Therefore, the pencil P can be more smoothly inserted into the guide hole 2*j*. Accordingly, the pencil P can be more efficiently sharpened.

As illustrated in FIGS. 6A, 6B, 7A, and 7B, the fixing member 4 includes the plurality of ribs 4*r* and 4*s* protruding inward. Therefore, the fixing member 4 can be reinforced, and it is possible to prevent a finger from entering the portion (incorporation portion 4*g*) where the blade portion 3 of the fixing member 4 is installed. Furthermore, the opening 4*a* in which the scrapings of the pencil P are accumulated is disposed on the side (lower side) opposite to the pencil P in the incorporation portion 4*g*. Therefore, after the pencil P is sharpened and the sharpener 1 is lifted, the scrapings accumulated in the opening 4*a* are in a collected state. Accordingly, the scrapings can be easily discarded thereafter. The scrapings can be automatically accommodated in a box having an open hole by fixing the sharpener 1 onto the box.

It is to be understood that not all aspects, advantages and features described herein may necessarily be achieved by, or included in, any one particular example embodiment. Indeed, having described and illustrated various examples herein, it should be apparent that other examples may be modified in arrangement and detail. We claim all modifications and variations coming within the spirit and scope of the subject matter claimed herein.

For example, in the above-described embodiments, the cover 2 made of the AS (SAN) resin having a substantially rectangular parallelepiped shape has been described. However, the shape, size, and material of the cover can be appropriately changed. The shape, size, and number of through-holes of the cover can be appropriately changed. Furthermore, the shape and size of the fixing member are not limited to those of the fixing member 4, and can be appropriately changed.

In the above-described embodiments, an example has been described in which the main body 1A of the sharpener 1 includes the cover 2 and the fixing member 4 separate from the cover 2. However, in the main body of the sharpener, the cover and the fixing member may not be separate from each other. Alternatively, the cover and the fixing member may be integrated with each other in the main body of the sharpener.

In the above-described embodiments, an example has been described in which the blade portion 3 has the first surface 3*b*, the second surface 3*c*, the third surface 3*d*, and the fourth surface 3*e*. However, the shape, size, arrangement, and number of blade portions can be appropriately changed. For example, two or more blade portions may be provided, or the blade portions may be installed to be inclined in the rightward/leftward direction or in the forward/rearward direction. The blade portion having two planes forming a V-shaped corner may be installed, or two blade portions may be installed so as to form a predetermined angle. In this manner, a shape of pencil P illustrated in FIGS. 13A and 13B can be accurately formed in a short time.

In the above-described embodiments, the sharpener 1 has been described. In the sharpener 1, the blade portion 3 extends obliquely downward as the blade portion 3 goes rearward, and the blade edge 3*a* facing forward sharpens the pencil P pulled rearward. However, in the sharpener, the blade edge facing rearward may sharpen the pencil P pressed forward.

In the above-described embodiments, the pencil P having the round bar shape has been described. However, the shape, size, and application of the pencil can be appropriately changed. That is, the sectional shape of the pencil when the pencil is cut along the cross section extending in the direction orthogonal to the longitudinal direction is not limited to the circular shape. The shape may be an ellipse, an oval, a triangle, a quadrangle, a pentagon, a hexagon, or other polygons. Furthermore, the shape, size, and material of the lead and the covering portion of the pencil can be appropriately changed. In this way, the sharpener according to the present invention can sharpen various types of pencil.

What is claimed is:

1. A sharpener for sharpening a pencil having an unsharpened portion and a writing tip portion to be sharpened, the sharpener comprising:

a main body having a fixing member and a cover detachably mounted on the fixing member, the cover having a front side, a rear side opposite the front side, and a guide hole, the guide hole having a first opening on the rear side and a second opening on the front side to accommodate a passage of the writing tip portion of the pencil through the main body;

a blade portion installed on the fixing member and located inside the main body, wherein the blade portion comprises:

a blade edge that is located at a fixed position to cut into the pencil when the pencil is drawn out of the first opening and through the guide hole in an axial direction, in order to sharpen the writing tip portion of the pencil when the blade edge is located at the fixed position; and a blade surface extending from the blade edge in a direction which is inclined with respect to the axial direction; and a contact portion located within the guide hole and located between the blade edge and the second opening of the guide hole, wherein the fixed position of the blade edge is fixed relative to the contact portion, wherein the contact portion is configured to raise the pencil away from the fixed position of the blade edge to prevent contact between the pencil and the blade edge when the unsharpened portion of the pencil contacts the contact portion.

2. The sharpener according to claim 1, wherein the guide hole extends between the blade surface and the cover.

3. The sharpener according to claim 1, wherein the cover has lateral sides joining the front side and rear side, and wherein the blade edge is oriented lengthwise between the lateral sides, to cut into the pencil when the pencil is drawn out of the guide hole in the axial direction.

4. The sharpener according to claim 1, wherein the guide hole has a first inner peripheral portion having a semi-circular shape to conform with an outer periphery of the pencil, and wherein the guide hole has a second inner peripheral portion having a linear surface which faces the first inner peripheral portion.

5. The sharpener according to claim 1, wherein a first distance taken between the contact portion and an inner peripheral surface of the guide hole facing the contact portion in a transverse direction that is transverse to the axial direction, is less than a second distance in the transverse direction taken between the fixed position of the blade edge and the inner peripheral surface.

6. The sharpener according to claim 5, wherein the contact portion is formed on the fixing member at a fixed position relative to the inner peripheral surface of the guide hole, to raise the pencil toward the inner peripheral surface of the guide hole, when the unsharpened portion of the pencil contacts the contact portion.

7. The sharpener according to claim 6, wherein the guide hole includes an inclined surface that extends from the blade edge toward the first opening, to accommodate a displacement of the pencil adjacent the inclined surface and away from the inner peripheral surface, when the pencil is drawn out of the first opening of the guide hole in the axial direction to cause the blade edge to cut into the pencil.

8. The sharpener according to claim 1, wherein an inner peripheral surface of the guide hole includes a first curved portion associated with a first radius, a linear portion opposite the first curved portion, and two curved portions located at opposite ends of the linear portion, wherein the two curved portions are associated with a second radius that is smaller than the first radius of the first curved portion, and wherein the blade edge is located adjacent the linear portion of the guide hole to cut into the pencil.

9. The sharpener according to claim 8, wherein the blade portion is located on an opposite side of the guide hole from the first curved portion.

10. The sharpener according to claim 8, wherein the linear portion includes a linear surface having a length in a direction perpendicular to a longitudinal axis of the guide hole that is equal to or greater than twice the first radius of the first curved portion, wherein the sharpener further comprises a protruding portion that extends from the linear portion of the guide hole out of the rear side of the main body.

11. The sharpener according to claim 1, wherein the contact portion and the blade edge are positioned to guide the pencil to move in a direction that causes the blade edge to cut along a radially inward plane of the pencil, to a tip end of the writing tip portion of the pencil.

12. A sharpener comprising:

a main body having a front side, a rear side opposite the front side, and a guide hole having a first opening on the rear side and a second opening on the front side, the guide hole to accommodate a passage of a pencil through the main body in an axial direction;

a blade located adjacent the guide hole, the blade having a blade edge located at a fixed position to cut into the pencil when the pencil is drawn out of the first opening and through the guide hole; and a contact portion located within the guide hole and located between the blade edge and the second opening of the guide hole, wherein the contact portion is located higher than the blade edge so that a first distance in an upward-downward direction that is transverse to the axial direction, taken between the contact portion and an inner peripheral surface of the guide hole facing the contact portion in the upward-downward direction, is less than a second distance in the upward-downward direction taken between the blade edge and the inner peripheral surface of the guide hole, wherein the second distance is taken when the blade edge is positioned at the fixed position to cut into the pencil, and wherein the contact portion is configured to raise the pencil away from the fixed position of the blade edge to prevent the pencil from contacting the blade edge when an unsharpened side surface of the pencil contacts the contact portion.

13. The sharpener according to claim 12, wherein the inner peripheral surface is located opposite to the blade edge and the contact portion to limit a movement of the pencil in a radial direction transverse to the axial direction.

14. The sharpener according to claim 12, wherein the contact portion is spaced away from the blade edge and wherein the contact portion has a curved surface to contact the pencil.

15. The sharpener according to claim 12, wherein the inner peripheral surface includes a curved inner peripheral surface that faces a linear inner peripheral surface of the guide hole.

16. The sharpener according to claim 12, wherein the inner peripheral surface includes:

a first curved portion that faces the contact portion and is associated with a first radius;

a linear portion that faces the first curved portion; and two curved portions located at opposite ends of the linear portion, wherein the two curved portions are associated with a second radius that is smaller than the first radius of the first curved portion.

17. The sharpener according to claim 12, wherein a third distance corresponding to a size of the first opening taken in the upward-downward direction, is greater than the second distance taken at the blade edge, to accommodate a displacement of the pencil away from the inner peripheral surface in the upward-downward direction, when the blade edge cuts into the pencil as the pencil is drawn out of the first opening of the guide hole.

18. The sharpener according to claim 17, wherein the inner peripheral surface extends in the axial direction of the guide hole, and wherein the guide hole includes an inclined surface that is inclined relative to the axial direction and that extends from the blade edge toward the first opening.

19. The sharpener according to claim 12, wherein the first distance taken at the contact portion and the second distance taken at the blade edge are set to space away the pencil from the blade edge, when the unsharpened side surface of the pencil extends from the contact portion in the axial direction.

* * * * *